US009433814B2

(12) United States Patent
von Hoffmann et al.

(10) Patent No.: US 9,433,814 B2
(45) **Date of Patent: *Sep. 6, 2016**

(54) TONING GARMENT WITH INTEGRATED DAMPER

(71) Applicant: Tau Orthopedics, LLC, Coto de Caza, CA (US)

(72) Inventors: Kaitlin von Hoffmann, Sunnyvale, CA (US); Gerard von Hoffmann, Coto de Caza, CA (US)

(73) Assignee: Tau Orthopedics, LLC, Coto de Caza, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/450,228

(22) Filed: Aug. 2, 2014

(65) Prior Publication Data

US 2014/0336020 A1 Nov. 13, 2014

Related U.S. Application Data

(63) Continuation-in-part of application No. 14/217,576, filed on Mar. 18, 2014, now Pat. No. 9,327,156, which is a continuation-in-part of application No. 14/192,805, filed on Feb. 27, 2014, now abandoned, which is a continuation-in-part of application No. 12/951,947, filed on Nov. 22, 2010, now Pat. No. 8,986,177, which is a continuation-in-part of application No. 12/797,718, filed on Jun. 10, 2010, now abandoned.

(60) Provisional application No. 61/218,607, filed on Jun. 19, 2009.

(51) Int. Cl.

| | |
|---|---|
| ***A63B 21/02*** | (2006.01) |
| ***A63B 21/00*** | (2006.01) |
| ***A63B 23/04*** | (2006.01) |
| *A63B 21/008* | (2006.01) |
| *A63B 21/055* | (2006.01) |
| *A63B 23/02* | (2006.01) |
| *A63B 23/12* | (2006.01) |

(52) U.S. Cl.

CPC ..... *A63B 21/00156* (2013.04); *A63B 21/02* (2013.01); *A63B 21/4011* (2015.10); *A63B 21/4017* (2015.10); *A63B 21/4039* (2015.10); *A63B 23/04* (2013.01); *A63B 23/0494* (2013.01); *A63B 21/0083* (2013.01); *A63B 21/0087* (2013.01); *A63B 21/023* (2013.01); *A63B 21/0552* (2013.01); *A63B 23/02* (2013.01); *A63B 23/1281* (2013.01); *A63B 2208/14* (2013.01)

(58) Field of Classification Search

USPC ..... 482/1–148

See application file for complete search history.

(56) References Cited

U.S. PATENT DOCUMENTS

| | | | |
|---|---|---|---|
| 2,664,566 | A | 1/1954 | Mianulli |
| 2,832,334 | A | 4/1958 | Whitelaw |

(Continued)

*Primary Examiner* — Stephen Crow

(74) *Attorney, Agent, or Firm* — Gerald von Hoffman; Aurora Consulting Group, LLC

(57) ABSTRACT

Disclosed is a muscle toning garment with force dampening resistance elements, which may be fluid filled rotary dampers. The garment provides resistance training throughout an angular range of motion. The garment may be low profile, and worn by a wearer as a primary garment or beneath conventional clothing. Toning may thereby be accomplished throughout the wearer's normal daily activities, without the need for access to conventional exercise equipment. Alternatively, the device may be worn as a supplemental training tool during conventional training techniques.

41 Claims, 25 Drawing Sheets

(56) References Cited

U.S. PATENT DOCUMENTS 4,065,814 A 1/1978 Fox
4,485,808 A 12/1984 Hepburn
4,621,620 A 11/1986 Anderson
4,657,000 A 4/1987 Hepburn
4,829,989 A * 5/1989 Deamer ..... A61F 5/02 602/19
4,875,677 A 10/1989 Tetreault
4,910,802 A 3/1990 Malloy
4,947,835 A 8/1990 Hepburn et al.
5,052,379 A 10/1991 Airy et al.
5,176,600 A 1/1993 Wilkinson
5,201,074 A * 4/1993 Dicker ..... A41D 13/0015 2/227
5,263,923 A 11/1993 Fujimoto
5,306,222 A 4/1994 Wilkinson
5,308,305 A 5/1994 Romney
5,337,737 A 8/1994 Rubin et al.
5,399,154 A 3/1995 Kipnis et al.
5,465,428 A 11/1995 Earl
5,472,412 A 12/1995 Knoth
5,527,244 A 6/1996 Waller et al.
5,553,322 A 9/1996 Cebo-Johnson
5,662,595 A 9/1997 Chesher et al.
5,685,811 A 11/1997 McShane et al.
5,720,042 A 2/1998 Wilkinson
5,749,840 A 5/1998 Mitchell et al.
5,788,618 A 8/1998 Joutras
5,792,034 A 8/1998 Kozlovsky
RE35,940 E 10/1998 Heinz et al.
5,867,827 A 2/1999 Wilkinson
5,875,491 A 3/1999 Wilkinson
5,937,441 A 8/1999 Raines
5,960,474 A 10/1999 Dicker et al.
5,976,063 A 11/1999 Joutras et al.
5,978,966 A 11/1999 Dicker et al.
5,993,362 A 11/1999 Ghobadi
6,039,677 A * 3/2000 Spletzer ..... A63B 21/0605 2/22
6,129,638 A * 10/2000 Davis ..... A63B 69/0059 473/215
6,176,816 B1 1/2001 Dicker et al.
6,186,970 B1 2/2001 Fujii et al.
6,210,354 B1 4/2001 Ousdal
6,231,488 B1 5/2001 Dicker et al.
6,314,580 B1 11/2001 Greenberg et al.
6,397,496 B1 6/2002 Seymour
6,409,693 B1 6/2002 Brannigan
6,440,094 B1 8/2002 Maas
6,656,097 B2 12/2003 Karecki
6,666,801 B1 * 12/2003 Michalow ..... A63B 69/0028 482/137
6,757,916 B2 7/2004 Mah et al.
6,834,752 B2 12/2004 Irby et al.
6,872,187 B1 3/2005 Stark et al.
6,954,968 B1 10/2005 Sitbon
7,048,098 B1 5/2006 Moradian
7,087,003 B1 8/2006 Katterjohn
7,153,246 B2 12/2006 Koscielny et al.
7,235,038 B2 6/2007 Liao
7,608,026 B1 10/2009 Nicassio
7,652,386 B2 1/2010 Donelan et al.
7,659,636 B2 2/2010 Donelan et al.
7,682,322 B2 3/2010 Engelman
7,744,511 B2 6/2010 Grigoriev et al.
7,758,481 B2 7/2010 Drennan
7,845,023 B2 12/2010 Swatee
7,849,518 B2 12/2010 Moore et al.
7,861,319 B2 1/2011 Torry
7,874,970 B2 1/2011 Glisan
7,931,571 B2 4/2011 Bernardoni
8,043,243 B2 10/2011 Nathanson et al.
8,060,945 B2 * 11/2011 Adarraga ..... A61F 5/0102 2/22
8,063,644 B2 11/2011 Rezvani et al.
8,171,570 B2 * 5/2012 Adarraga ..... A61F 5/0102 2/22
8,273,001 B2 * 9/2012 Karecki ..... A63B 21/4025 2/22
8,312,646 B2 11/2012 Meschter et al.
8,409,117 B2 4/2013 Cheng et al.
8,544,114 B2 10/2013 Williams et al.
8,555,415 B2 10/2013 Bradstreet et al.
8,663,133 B2 3/2014 Johnson et al.
8,951,136 B1 * 2/2015 Booher ..... A63B 69/3608 473/215
8,986,177 B2 3/2015 von Hoffmann et al.
2001/0029224 A1 10/2001 Karecki
2004/0116260 A1 6/2004 Drennan et al.
2005/0101887 A1 5/2005 Stark et al.
2005/0148915 A1 7/2005 Nathanson et al.
2005/0255975 A1 * 11/2005 Horn ..... A63B 21/0004 482/124
2005/0261113 A1 * 11/2005 Wilkinson ..... A63B 21/0004 482/124
2006/0000478 A1 1/2006 Taylor
2006/0016649 A1 1/2006 Gordaninejad et al.
2006/0046913 A1 3/2006 Squittieri
2006/0079825 A1 4/2006 Hilton et al.
2006/0096818 A1 5/2006 Moradian
2006/0272071 A1 12/2006 Mickle
2007/0010772 A1 1/2007 Ryan
2007/0016120 A1 1/2007 Latronica et al.
2007/0032359 A1 2/2007 Toronto
2007/0100265 A1 5/2007 Gamada
2007/0123997 A1 5/2007 Herr et al.
2007/0135279 A1 6/2007 Purdy et al.
2008/0026917 A1 1/2008 Campana
2008/0108918 A1 5/2008 Joutras et al.
2009/0253325 A1 10/2009 Brookstein et al.
2010/0041527 A1 2/2010 Miller
2010/0075557 A1 3/2010 Shteiyer
2010/0077527 A1 4/2010 Lee et al.
2010/0144490 A1 6/2010 Purdy et al.
2010/0223717 A1 9/2010 Foy et al.
2010/0248915 A1 9/2010 Gibson-Horn
2010/0267525 A1 10/2010 Tanner
2010/0323859 A1 * 12/2010 Von Hoffmann .. A63B 21/4017 482/124
2011/0010001 A1 1/2011 Chung et al.
2011/0111932 A1 5/2011 Von Hoffmann et al.
2011/0126335 A1 6/2011 Schultz
2011/0224585 A1 9/2011 Hall
2011/0231986 A1 9/2011 Waldie et al.
2011/0247127 A1 * 10/2011 Pou ..... A41D 13/0012 2/227
2012/0094811 A1 * 4/2012 Karecki ..... A63B 21/4025 482/121
2012/0225755 A1 9/2012 Lloyd
2013/0085040 A1 4/2013 Bowers
2013/0130874 A1 5/2013 Richardson et al.
2013/0150218 A1 6/2013 Mial
2013/0190147 A1 7/2013 Luo et al.
2013/0247330 A1 9/2013 Daul et al.
2013/0298301 A1 11/2013 Petrakis et al.
2014/0109282 A1 4/2014 White et al.
2014/0173934 A1 6/2014 Bell
2014/0200121 A1 7/2014 von Hoffmann et al.
2014/0207030 A1 7/2014 Hall
2014/0336020 A1 11/2014 von Hoffmann et al.
2015/0190669 A1 * 7/2015 Matsuura ..... A63B 21/02 482/8
2015/0258360 A1 9/2015 von Hoffmann et al.
2016/0038783 A1 2/2016 Matsuura et al.

* cited by examiner training

TONING GARMENT WITH INTEGRATED DAMPER

CROSS-REFERENCE TO RELATED APPLICATIONS

This application is a continuation in part of U.S. patent application Ser. No. 14/217,576 filed Mar. 18, 2014, which is a continuation in part of U.S. patent application Ser. No. 14/192,805 filed Feb. 27, 2014, which is a continuation-in-part of U.S. patent application Ser. No. 12/951,947, filed on Nov. 22, 2010, which is a continuation-in-part of U.S. patent application Ser. No. 12/797,718, filed on Jun. 10, 2010 which claims the benefit of U.S. Provisional Application No. 61/218,607, filed Jun. 19, 2009, the entirety of these applications are hereby incorporated by reference herein.

BACKGROUND OF THE INVENTION

Resistance training, sometimes known as weight training or strength training, is a specialized method of conditioning designed to increase muscle strength, muscle endurance, tone and muscle power. Resistance training refers to the use of any one or a combination of training methods which may include resistance machines, dumbbells, barbells, body weight, and rubber tubing.

The goal of resistance training, according to the American Sports Medicine Institute (ASMI), is to "gradually and progressively overload the musculoskeletal system so it gets stronger." This is accomplished by exerting effort against a specific opposing force such as that generated by elastic resistance (i.e. resistance to being stretched or bent). Exercises are isotonic if a body part is moving against the force. Exercises are isometric if a body part is holding still against the force. Resistance exercise is used to develop the strength and size of skeletal muscles. Full range of motion is important in resistance training because muscle overload occurs only at the specific joint angles where the muscle is worked. Properly performed, resistance training can provide significant functional benefits and improvement in overall health and well-being.

Research shows that regular resistance training will strengthen and tone muscles and increase bone mass. Resistance training should not be confused with weightlifting, power lifting or bodybuilding, which are competitive sports involving different types of strength training with non-elastic forces such as gravity (weight training or plyometrics) an immovable resistance (isometrics, usually the body's own muscles or a structural feature such as a door frame).

Whether or not increased strength is an objective, repetitive resistance training can also be utilized to elevate aerobic metabolism, for the purpose of weight loss.

Resistance exercise equipment has therefore developed into a popular tool used for conditioning, strength training, muscle building, and weight loss. Various types of resistance exercise equipment are known, such as free weights, exercise machines, and resistance exercise bands or tubing. Various limitations exist with the prior art exercise devices. For example, many types of exercise equipment, such as free weights and most exercise machines, are not portable. With respect to exercise bands and tubing, they may need to be attached to a stationary object, such as a closed door or a heavy piece of furniture, and require sufficient space. This becomes a problem when, for example, the user wishes to perform resistance exercises in a location where such stationary objects or sufficient space are not readily found.

Resistance bands are also limited to a single resistance profile in which the amount of resistance changes as a function of angular displacement of the joint under load. This may result in under working the muscles at the front end of a motion cycle, and over working the muscles at the back end of the cycle. Conventional elastic devices also provide a unidirectional bias that varies in intensity throughout an angular range but not in direction. Such devices thus cannot work both the flexor and extensor muscles of a given motion segment without adjustment.

A need therefore exists for resistance based wearable toning equipment that may be used on its own without the need to employ other types of equipment, and that applies a non-elastic load throughout both a flexion and extension range of motion.

SUMMARY OF THE INVENTION

There is provided in accordance with one aspect of the present invention, a low profile, wearable, dynamic resistance toning device. The dynamic resistance device comprises a garment having a waistband, for attachment around the waist of a wearer, a left leg and a right leg.

At least one left leg resistance unit and at least one right leg resistance unit is carried by the garment. The resistance units may impart single direction or bidirectional resistance to movement throughout a range of motion.

The resistance units may impose a first level of resistance to movement across the hip, and a second level of resistance across the knee, where the first level is greater than the second level. Each of a left and right resistance units may impose a resistance to movement to at least about 10 inch pounds of torque across the hip. In some implementations of the invention, the device imposes a resistance to movement at the hip of at least about 15, or 20 or 25 or 30 or more inch pounds, and resistance of movement at the knee of at least about 5 or 10 or 15 or more inch pounds, for each of the right and left legs. The resistance units may comprise a fluid filled damper, such as a rotary damper.

Further features and advantages of the present invention will become apparent to those of skill in the art in view of the detailed description of preferred embodiments which follows, when considered together with attached drawings and claims.

DETAILED DESCRIPTION OF THE PREFERRED EMBODIMENT

Figure 1:
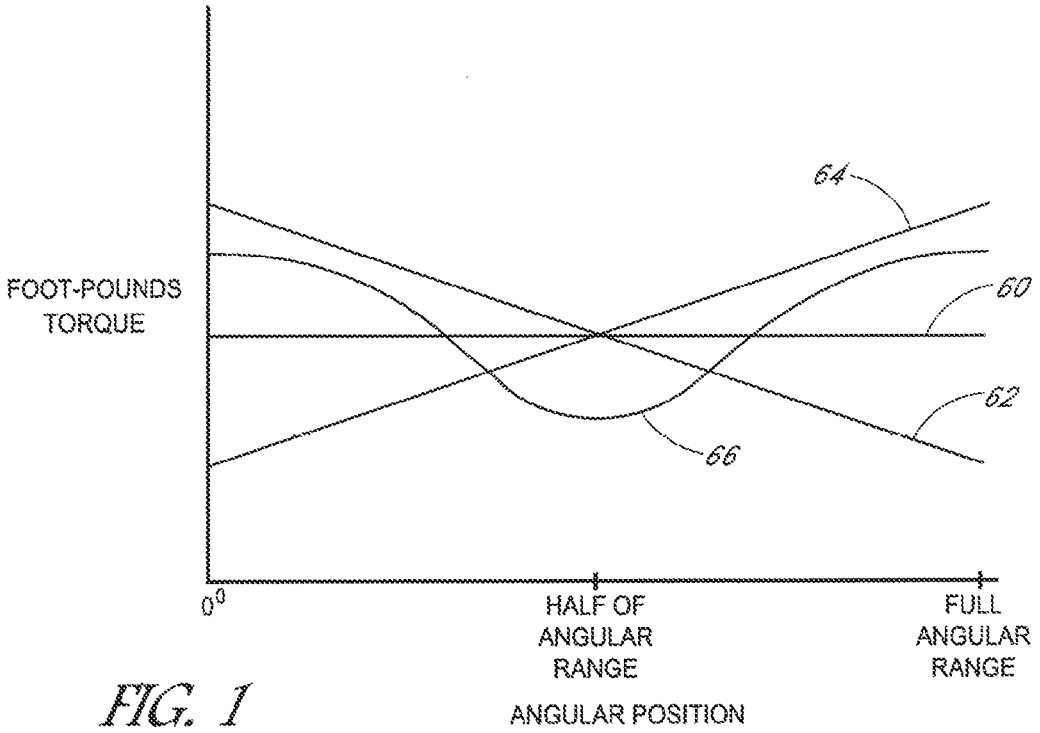
FIG. 1 is a plot of different resistance profiles as a function of angular rotation of a joint.

Detailed descriptions of the preferred embodiments are provided herein. It is to be understood, however, that the present invention may be embodied in various other forms. Therefore, specific details disclosed herein are not to be interpreted as limiting, but rather as a basis for the claims and as a representative basis for teaching one skilled in the art to employ the present invention in virtually any appropriately detailed system, structure or manner.

The knee joint is a uni-axial hinge joint. The knee moves in a flexion (bending of the knee) and extension (straightening of the knee) direction. The three major bones that form the knee joint are: the femur (thigh bone), the tibia (shin bone), and the patella (kneecap). The prime muscle movers of the knee joint are the quadriceps muscles (on top of the femur), which move the knee into extension; and the hamstring muscles (underneath the femur), which move the knee into flexion. The quadriceps muscles are made up of five muscles known as the rectus femoris, vastus lateralis, vastus medialis, vastus intermedius and a secondary muscle, the vastus medialis oblique (VMO). The hamstring is made up of three muscles known as the biceps femoris, semimembranosus, and semitendinosus. The hamstring to quadriceps muscle strength ratio is two-thirds; meaning, the hamstring is normally approximately thirty-three percent weaker than the quadriceps. The muscles, ligaments, nervous system, and skeletal system work in unison to stabilize the knee during gait activities (walking, running, jumping).

In general, the devices in accordance with the present invention are designed to provide resistance to motion between a first region and a second region of the body such as across a simple or complex joint, (e.g., hip, knee, shoulder, elbow, etc.), throughout an angular range of motion. The resistance can be either unidirectional, to isolate a single muscle or muscle group, or preferably bidirectional to exercise opposing muscle pairs or muscle groups. Optionally, the device will be user adjustable to select uni or bidirectional resistance.

In the example of a device to apply a load under motion across the knee, configured to train quadriceps, the device imposes resistance to extension of the lower leg at the knee joint and throughout the angular range of motion for the knee. During flexion (movement in the return direction) the device may be passive without providing any resistance to movement. Alternatively, in a bidirectional device, the device imposes resistance throughout both extension and flexion in this example to train both the quadriceps and the hamstring muscles. The resistance to flexion and extension may be equal, or may be dissimilar, depending upon the objective of the exercise.

The devices in accordance with the present invention may also be provided with a user adjustable load or resistance.

In one implementation of the invention, the device provides passive resistance to motion throughout an angular range. At any stationary point within the range, the device imposes no bias. Rather the device merely resists movement in either one or both of flexion and extension. In contrast, an elastic resistance device imparts bias at any time it is deflected from neutral, whether moving or at a stop.

In one mode of operation, the device is worn over an extended period of time wherein the activities of the wearer are dominantly aerobic as distinguished from anaerobic (i.e. dominantly non-anaerobic). The invention may be practiced where some of the activities are of an anaerobic nature, depending upon the training objective of the wearer. The extended period of time could be as short as one hour or less but is preferably at least two hours and sometimes at least eight hours, although it could also be at least about four hours or six hours or more.

The present invention is intended primarily for use to build strength under conditions which favor aerobic metabolism, which will as a necessary consequence be accompanied by an elevated consumption of body fat. Thus the present invention may also comprise methods of achieving weight loss, by wearing one or two or more passive resistance devices for an extended period of time (disclosed elsewhere herein) each day for at least two or three or four or five or more days per week. The present invention also contemplates methods of reducing percent body fat via the same method steps.

Yet other embodiments of the present invention include biometric sensors and electronic data storage and/or wireless data export to a remote receiver such as a smartphone or other wireless device. In some embodiments, the sensors detect electrical signals which are related to the load being transmitted by the force modifying apparatus, the angular position of the upper leg attachment relative to the lower leg attachment, and/or the angular velocity of the upper leg attachment relative to the lower leg attachment, temperature, pulse or other data of interest.

Various dimensions and materials are described herein. It is understood that such information is by example only, and is not limiting to the inventions.

The angular range of motion permitted by the dynamic joint 54 may be within the range of from about 0° (straight leg) to about 145° or more. Typically, an angular range of motion between about 0 and about 45 or 55° is sufficient for a joint such as the knee.

A bi-directional exercise device provides resistance to movement in both the flexion and extension directions. However, the level of resistance may differ. For example, in a normal knee, the ratio of the natural strength of a hamstring to a quadricep is roughly 1:3. A balanced passive resistance device may therefore impose 1 lb. of resistance on flexion for every 3 lbs. of resistance on extension. However, for certain athletic competitions or other objectives, the wearer may desire to alter the basic strength ratio of the unexercised hamstring to quadricep. So for example, the passive exercise device 20 may be provided with a 2 lb. resistance on flexion for every 3 lb. resistance on extension or other ratio as may be desired depending upon the intended result.

In any of the embodiments disclosed herein, whether mechanical braces, fabric garments or hybrids, the resistance to movement will be relatively low compared to conventional weight training in view of the intended use of the apparatus for hours at a time. Anaerobic metabolism may be elevated by repetitively placing a minor load on routine movement over an extended period. The load will generally be higher than loads placed by normal clothing and technical wear, and preselected to work particular muscle groups. Preferably, the resistance elements may be adjusted or interchanged with other elements having a different resistance, or additive so that adding multiple resistance elements can increase the net resistance in a particular resistance zone.

The specific levels of resistance will vary from muscle group to muscle group, and typically also between flexion and extension across the same muscle group. Also wearer to wearer customization can be accomplished, to accommodate different training objectives. In general, resistances of at least about 0.5, and often at least about 1 or 2 or 3 or more foot-pounds will be used in most applications on both flexion and extension. Devices specifically configured for rehabilitation following injury (traumatic injury or surgical procedure) may have lower threshold values as desired. Across the hip or knee, resistance against extension in healthy patients may be within the range of from about 2 to about 75 foot-pounds, more commonly within the range of from about 2 to about 25 foot-pounds, such as at least about 5, 7.5, 10 or 15 foot-pounds. Resistance against flexion will typically be less, such as within the range of from about 1 to about 50 foot-pounds, and often within the range of from about 2 to about 25 foot-pounds. Values of at least about 5, 7.5 or 10 foot pounds may be appropriate depending upon the wearer's objectives. The resistance to extension might be at least about 130%, sometimes at least about 150% and in some embodiments at least about 200% of the resistance to the corresponding flexion. Toning garments intended for long term wear may have lower resistance, such as at least about 10 inch pounds, or at least about 15 or 20 or 25 or 30 or more inch pounds under flexion or extension with extension normally equal to or greater than flexion.

The resistance garment may impart any of a variety of resistance profiles, as a function of angular displacement of the joint. For example, FIG. 1 schematically and qualitatively illustrates the units such as foot pounds (easily expressed as inch pounds or various other conventions known in the art) of resistance to movement in either or both an extension or flexion direction, as a function of the angular deviation of the joint across a dynamic motion range. In this illustration, an angle of zero may represent a limb in a "start" or straight or other reference configuration, while the midpoint of the range of motion is half way through the range of motion of the target join or motion segment. The maximum range of motion is the maximum normal range for the target joint.

Referring to plot 60, there is illustrated an example in which the resistance to movement is constant throughout the angular range of motion, as a function of angle. Thus, at whatever point the distal extremity may be throughout the angular range of motion with respect to the proximal anatomy, incremental motion encounters the same resistance as it would at any other point throughout the angular range of motion. If motion stops, the resistance stops and there is no net bias or force applied by the device against the distal extremity.

Alternatively, referring to plot 62, there is illustrated the force curve relating to a dynamic joint in the garment in which the resistance to motion is greatest at the beginning of deviation from a starting point, and the resistance to motion falls off to a minimum as the distal extremity reaches the limit of its angular range.

Referring to plot 64, the garment imposes the least resistance at the beginning of bending the limb from the starting point, and the force opposing motion increases as a function of angular deviation throughout the range of motion. This may be utilized, for example, to emphasize building strength on the back half or back portion of an angular range of motion.

As a further alternative, referring to plot 66, the garment may be configured to produce the most strength at the end points of the range of motion, while deemphasizing a central portion of the range of motion. Although not illustrated, the inverse of the plot 66 may additionally be provided, such that the end points in either direction of the angular range of motion across a joint are deemphasized, and strength throughout the middle portion of the range of motion is emphasized.

As will be apparent to those of skill in the art, any of a variety of resistance profiles may be readily constructed, depending upon the desired objective of the training for a particular athlete or rehabilitation protocol. In some implementations the resistance varies as a function of velocity, so that the faster the wearer seeks to move through a given range of motion, the proportionally higher the responsive resistance. Resistance remains constant in response to constant velocity motion. This performance profile in essence allows the wearer to customize the resistance level, in response to effort, and may be desirable in the medical rehabilitation markets as well as the related markets of toning and training.

Figure 2:
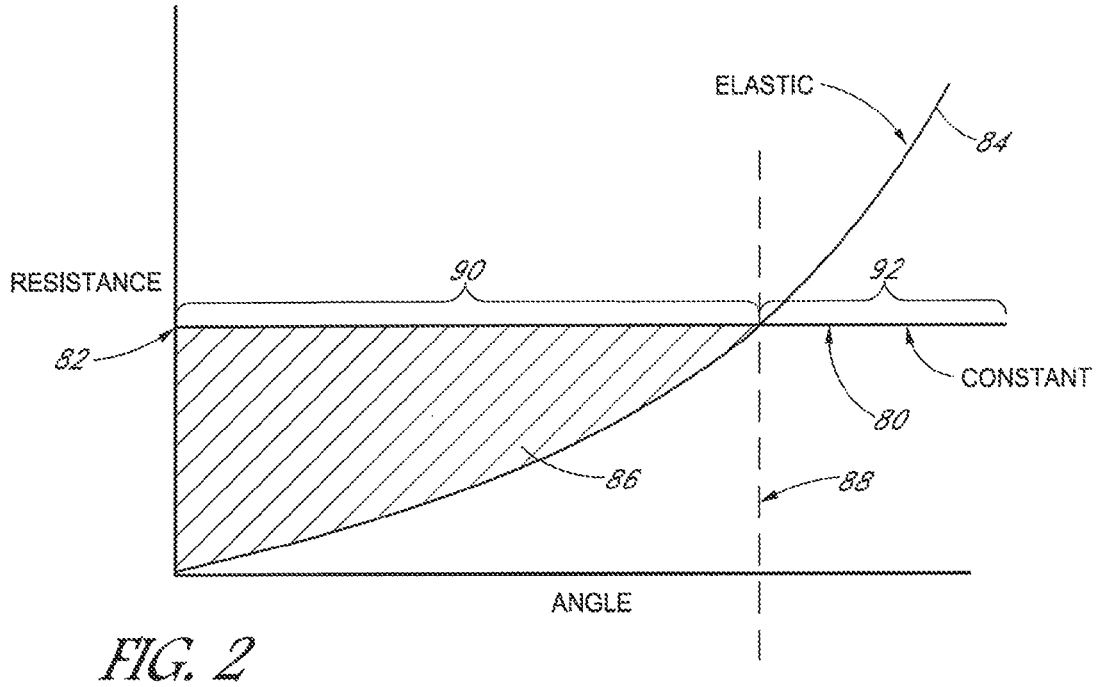
FIG. 2 illustrates a comparison in muscle loading throughout an angular range for a constant resistance device and an elastic resistance device.

Referring to FIG. 2, there is illustrated a qualitative relationship between a constant and an elastic resistive force, throughout a range of motion. The constant force line 80 remains essentially unchanged as a function of angular displacement from any starting point. So the work required to move in opposition to the resistance is at its predetermined value 82 starting at the beginning of any movement within the range, throughout both an early cycle 90 and a late cycle 92.

In contrast, extension (or flexion) throughout an angular range against an elastic resistive force encounters a variable resistance which starts low and increases as a function of the angle of displacement. This elastic resistive force is represented by line 84. Throughout an early cycle 90, resistance may be less than the predetermined value 82 until the elastic has been sufficiently loaded that the elastic resistance curve 84 crosses the predetermined value 82 of the constant resistance line 80 at a transition 88. Only angular displacement within the late cycle 92 encounters resistance at or above the predetermined value 82.

The angle zero can be any reference point throughout the walking cycle, such as standing straight up, or with the leg at the most posterior part of the stride, wherever the elastic has been designed to provide neutral (zero) bias. The shaded area 86 represents work that would be accomplished under the constant resistance device, but would not be accomplished during the early cycle 90 for the elastic device as the elastic is loading and resistance is climbing. Thus the constant resistance device forces work throughout the angular range, while never exceeding a predetermined maximum resistance force, but the elastic may provide inadequate resistance throughout the early cycle 90. This is important because strength is best developed throughout the range of motion that is actually exercised under load, so elastic mechanisms may inadequately load the muscles in the early cycle 90. The shaded area 86 thus represents the inefficiency in an elastic resistance system compared to a constant resistance system.

Early cycle loading in an elastic model can be elevated by pre-tensioning the elastic so that at angle zero the resistance is already up to the reference value 82. But the device now has lost its neutral bias resting position and at all angles throughout the cycle the wearer will be fighting a bias which may be undesirable. In addition, pre-tensioning the elastic will also elevate resistance throughout the late cycle 92 potentially above what the wearer can tolerate or at least sufficiently that the wearer will simply shorten their stride to avoid the resistance spike. Thus maintaining resistance within a range of at least a threshold minimum and a maximum throughout the angular range of motion is preferred. The maximum will generally be less than about 3×, generally less than about 2× the minimum, and in different settings no more than about 80%, 50%, 25%, 10% or 5% or 2% greater than the minimum. In general, substantially constant resistance means plus or minus no more than about 10% from the average resistance throughout the working range.

Figure 3:
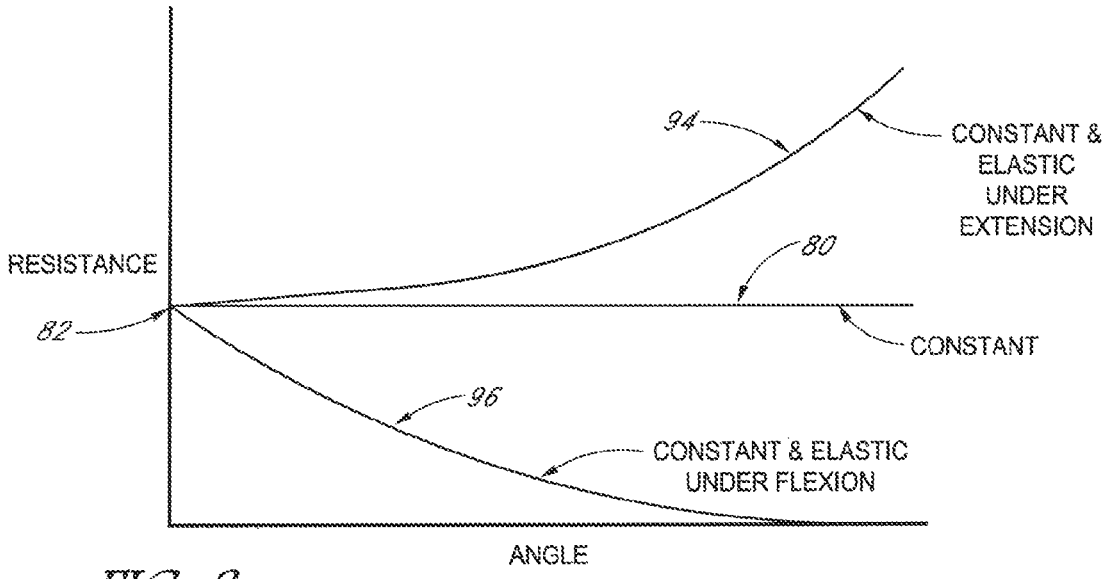
FIG. 3 illustrates a comparison in muscle loading throughout an angular range for a hybrid resistance device having a constant resistance component and an elastic resistance component.

Referring to FIG. 3, the performance of a hybrid garment is illustrated, in which both a constant resistance component and an elastic component are present. This might be accomplished, in the copper rod example described below, by securing one or more spring wire elements (stainless steel, NiTinol or other elastic metals or polymers known in the art) in parallel with the passive resistive element. Bending across the joint thus both bends the passive component as well as the spring or elastic component.

Thus the net force curve on, for example, extension is illustrated as 94 and represents the sum of the resistance from the passive and elastic components assuming the elastic component is configured to be fully relaxed at the reference angle zero. However, under flexion, the elastic component assists flexion in opposition to the resistance from the passive component, producing a curve more like 96 in which resistance to flexion climbs as the angular deviation returns to the reference point. Hybrid elastic/passive configurations can be used where a different resistance profile is desired for flexion compared to extension across a particular motion segment.

In any of the foregoing embodiments, it may be desirable to provide a release which disengages the resistance to movement upon an abrupt increase in force from the wearer. The release may be in the form of a releasable detent or interference joint which can be opened by elastic deformation under force above a preset threshold which is set above normally anticipated forces in normal use. If a wearer should stumble, the reflexive movement to regain balance will activate the release and eliminate resistance to further movement, as a safety feature.

Figure 4:
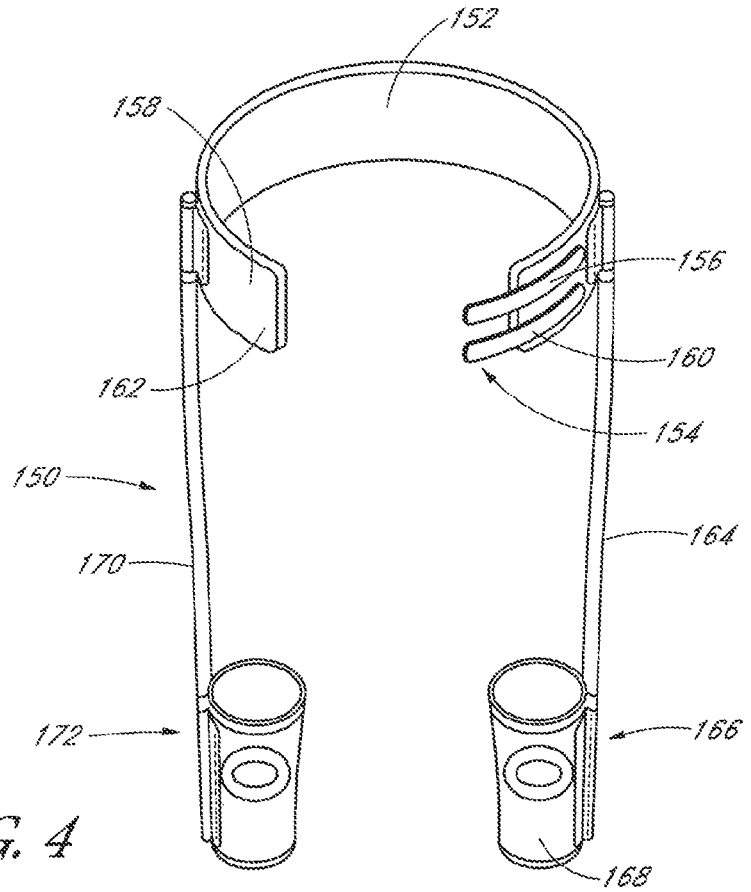
FIG. 4 is a front perspective view of an exercise device in accordance with the present invention, for providing resistance to movement at the hip.

Resistance exercise devices in accordance with the present invention may also be configured for use with larger muscle groups or more complex muscle sets, such as the exercise device illustrated in FIG. 4 which is adapted for providing resistance to movement at the hip. The exercise device 150 comprises a superior attachment structure such as a waistband 152 for encircling the waist of the wearer. Waistband 152 if provided with a closure structure 154, such as at least a first attachment structure 156 and optionally a second attachment structure 160. First attachment structure 156 and second attachment structure 160 cooperate with corresponding attachment structures 158 and 162 to enable secure closure of the waistband 152 about the waist of the wearer, in an adjustable manner. Any of a variety of closure structures such as belts, buckles, hook and loop or Velcro strips, snaps, or others disclosed elsewhere herein may be utilized.

A first (left) resistance element 164 is secured to the waistband 152 and extends across the hip to a first inferior attachment structure 166. The first inferior attachment structure 166 may comprise any of a variety of structures for securing the first resistance element 164 to the wearer's leg. As illustrated, the first inferior attachment structure 166 is in the form of a cuff 168, adapted to surround the wearer's knee. The cuff 168 may alternatively be configured to surround the wearer's leg above or below the knee, depending upon the desired performance characteristics. Cuff 168 may be provided with an axial slit for example running the full length of the medial side, so that the cuff may be advanced laterally around the wearer's leg, and then secured using any of a variety of snap fit, Velcro or other adjustable fasteners. Alternatively, the cuff 168 may comprise a stretchable fabric cuff, that may be advanced over the wearer's foot and up the wearer's leg into position at the knee or other desired location.

As will be apparent from FIG. 4, the exercise device 150, as worn, will provide resistance to movement at the hip in an amount that depends upon the construction of first resistance element 164. First resistance element 164 may comprise any of a variety of structures or fabrics which provide resistance to movement, as have been described elsewhere herein. In one embodiment, first resistance element 164 comprises one or more elongate elements such as a rod or bar of homogeneous bendable material. In one embodiment, the first resistance element comprises one or more elongate copper rods, having a diameter within the range of from about 0.125 or 0.25 inches to about 0.75 inches. As the wearer advances a leg forward from a first, neutral position to a second, forward position, the rod bends to provide resistance. The malleable nature of this material causes the force to stop once the leg has reached the second, forward position. As the leg is brought rearwardly from the second, forward position, the rod again bends, providing resistance to movement in the opposite direction. This resistance may be considered passive, and the rod exerts no directional bias in the absence of motion by the wearer.

Alternatively, the first resistance element 164 may comprise a material which provides an active bias in any predetermined direction. For example, a rod or coil spring comprising a material such as spring steel, Nitinol, or a variety of others known in the art, will provide zero bias in its predetermined neutral position. However, any movement of the wearer's leg from the predetermined zero position will be opposed by a continuous and typically increasing bias. Thus, even when the wearer's leg is no longer in motion, the first resistance element 164 will urge the wearer's leg back to the preset zero position.

The exercise device 150 is preferably bilaterally symmetrical, having a second resistance element 170 and a second inferior attachment 172 formed essentially as a mirror image of the structure described above.

The bending characteristics of the first resistance element near the attachment to the belt may be optimized by providing a first tubular support concentrically disposed over a second tubular support in a telescoping relationship which is concentrically disposed over the first resistance element 164. This structure enables control of the flexibility characteristics and moves the bending point inferiorly along the length of the first resistance element 164.

The first and second resistance elements 164 and 170 can be provided in a set of graduated resistance values such as by increasing cross-sectional area, or by increase in the number of resistance elements 164. Thus, the belt can be configured to support a first, second and third tubular support elements for receiving a first, second and third resistance element 164. One or two or three or four or more resistance elements may be provided, depending upon the construction of the resistance element as will be apparent to those of skill in the art in view of the disclosure herein.

At least a right and a left safety release may be provided, to release the resistance from the right and left resistance elements in response to a sudden spike in force applied by the wearer such as might occur if the wearer were to try to recover from missing a step or tripping. The release may be configured in a variety of ways depending upon the underlying device design. For example, in a solid flexible rod resistance element, a short section of rod may be constructed of a different material which would snap under a sudden load spike. That resistance element would be disposed and replaced once the release has been actuated. Alternatively, a male component on a first section of the resistance element can be snap fit with a female component on a second section of the resistance element, such that the two components become reversibly disengaged from each other upon application of a sudden force above the predetermined safety threshold. Two components can be pivotable connected to each other along the length of the resistance element, but with a coefficient of static friction such that movement of the pivot is only permitted in response to loads above the predetermined threshold. Alternatively, one or more of the belt connectors or corresponding inferior connectors can be releasably secured with respect to the wearer. Any of a variety of interference fit attachment structures or hook and loop fasteners can be optimized to reversibly release upon application of the threshold pressure. In more complex systems or systems configured for relatively high resistance such as for heavy athletic training, more sophisticated release mechanisms may be configured such as those used in conventional ski bindings and well understood in the art.

Figure 5:
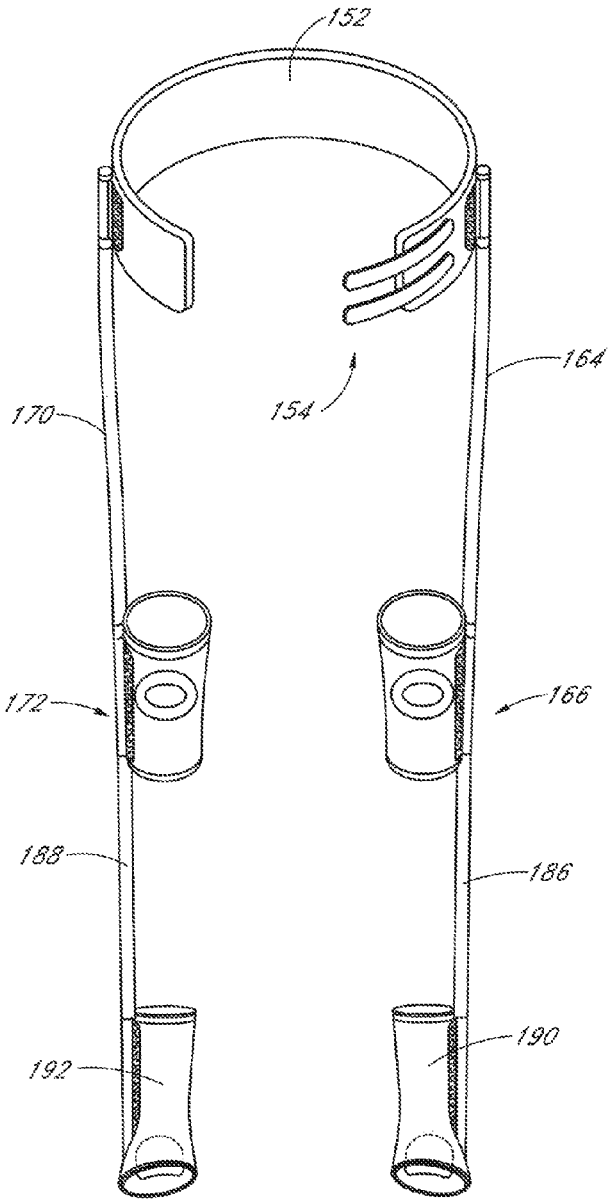
FIG. 5 is a front perspective view of an exercise device, for providing resistance to movement at both the hip and the knee.

Referring to FIG. 5, there is disclosed a further implementation of the present invention, which provides resistance to movement at both the hip as well as the knee. The embodiment of FIG. 5 is similar to that illustrated in FIG. 4, with the addition of a third resistance element 186 and a fourth resistance element 188 extending from the knee to the foot, ankle or leg below the knee. In the illustrated embodiment, the third resistance element 186 extends inferiorly to a foot or ankle support 190. The fourth resistance element 188 extends inferiorly to a second foot or ankle support 192. The foot or ankle supports 190 and 192 may comprise any of a variety of structures, such as an ankle band for surrounding the ankle, a boot or sock for wearing on the foot, and/or a shoe or other article to be attached in the vicinity of the foot.

Figure 6:
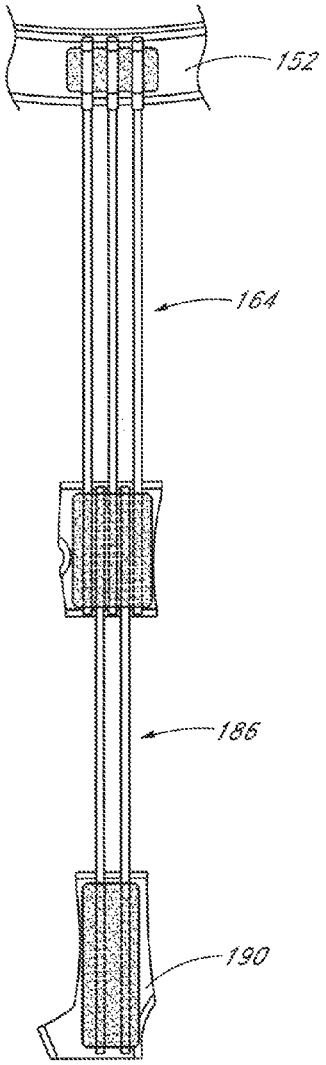
FIG. 6 is a side elevational view of the exercise device of FIG. 5, in which a greater degree of resistance is provided to movement at the hip compared to the knee.

Referring to FIG. 6, there is illustrated a side elevational view of an implementation of the design illustrated in FIG. 5. In this implementation of the invention, a first, second and third resistance elements are provided between the waistband and the knee, to provide a first level of resistance to movement. A first and second resistance elements are provided between the knee and the ankle, to provide a second, lower level of resistance between the femur and the ankle. Thus, different muscle groups may be challenged by different level of resistance as has been discussed previously herein.

Figure 8:
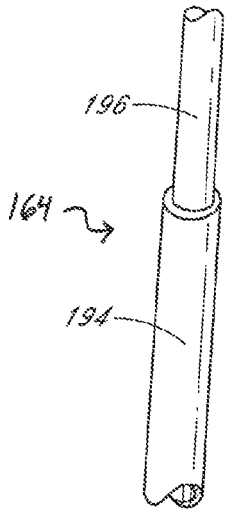
FIG. 8 is a partial elevational view of a resistance element in accordance with the present invention.
Figure 9A:
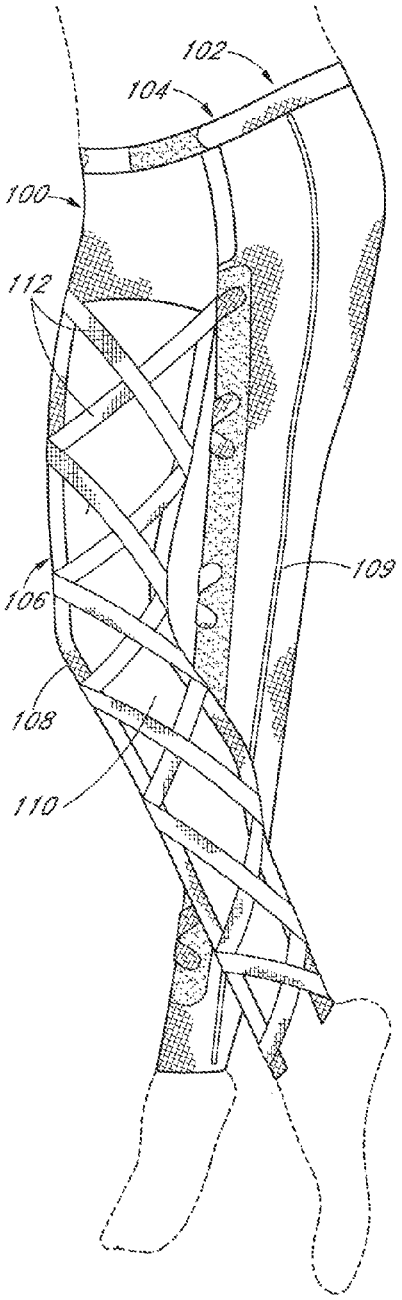
FIGS. 9A and 9B are perspective views of an alternative resistance garment in accordance with the present invention.
Figure 9B:
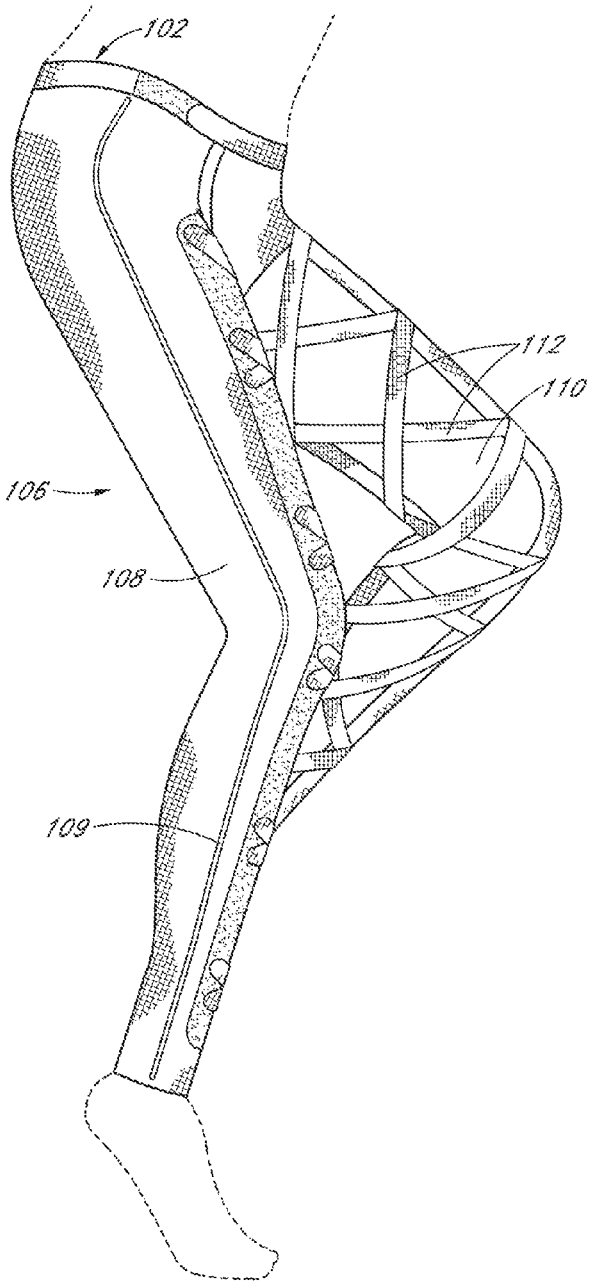
Figures 10, 11:
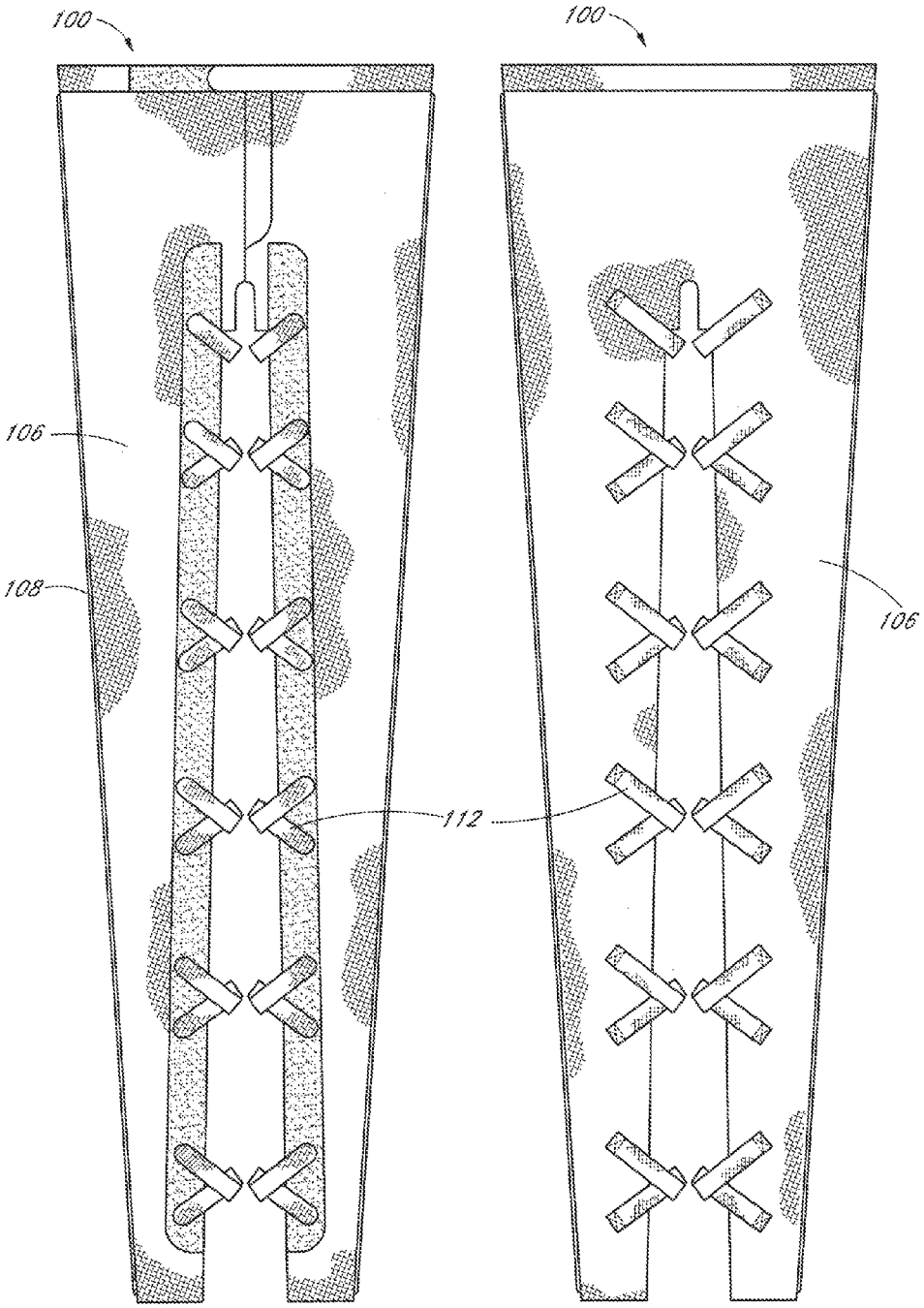
FIG. 10 is a front schematic view of a garment such as that in FIG. 9.
FIG. 11 is a rear schematic view of a garment such as that in FIG. 9.

A partially exploded view of a segment of a resistance element 164 is illustrated in FIG. 8. In one implementation of the invention, the attachment structure for attaching a resistance element to the body may be one or more belts, cuffs or garments as has been described herein. The attachment structure is provided with at least one sleeve 194 extending on a generally superior inferior axis on each side of the body and optionally on the medial side (inseam) of each leg. Sleeve 194 comprises any of a variety of flexible materials, such as fabric or polymeric tubing.

Sleeve 194 removably receives a resistance core 196. Core 196 may comprise one or more solid copper rods, segmented resistance element (discussed below) or other element which resist bending. A plurality of sleeves 194 may be provided on a garment or other attachment structure, such as two or three or four or five or more, extending in parallel to each other across a joint or other motion segment to provide a multi-component resistance element. The wearer may elect to introduce a resistance core 196 into each of the sleeves 194 (e.g. for maximum resistance) or only into some of the sleeves 194 leaving other sleeves empty. In this manner, the wearer can customize the level of resistance as desired.

Passive resistance or biased resistance to movement in accordance with the present invention may be built into a partial or full body suit, depending upon the desired performance characteristics. Resistance may be built into the body suit in any of a variety of ways, such as by incorporation of any of the foregoing structures (wires or other malleable materials) into the body suit, and/or incorporation of elastic stretch or flex panels of different fabrics as will be disclosed below.

Figure 7:
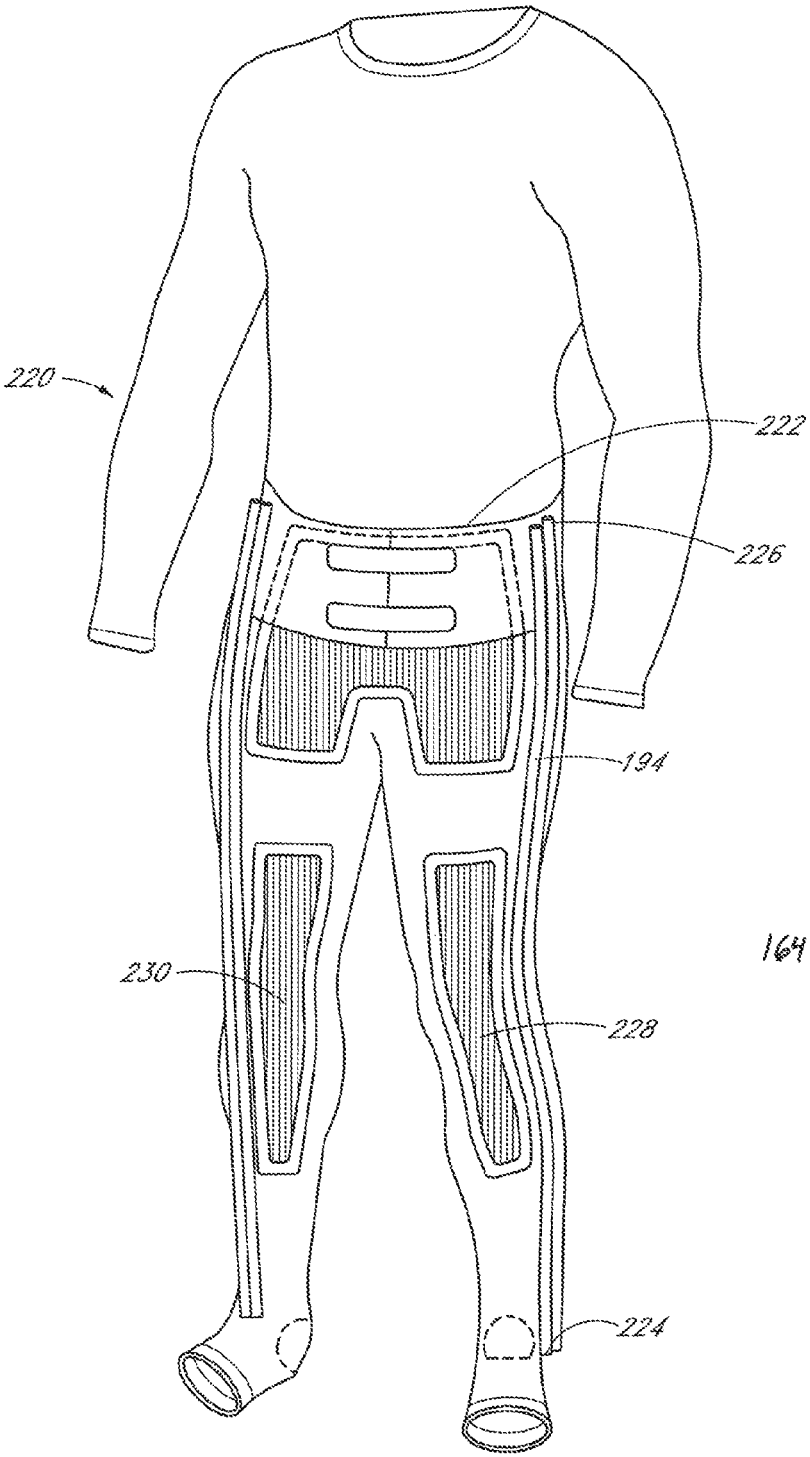
FIG. 7 is a front elevational view of a garment incorporating resistance features in accordance with the present invention.

Referring to FIG. 7, there is illustrated a front elevational view of a garment in the form of a full body suit 220, incorporating resistance elements in accordance with the present invention. Although illustrated as a full body suit, the garment may be in the form of pants alone, from the waist down, or an upper body garment similar to a shirt. In general, the body suit is provided with one or more resistance elements spanning a joint of interest, as has been discussed herein. The resistance element may be any of the devices disclosed previously herein, either removably or permanently attached to the fabric of the garment. For example, in the illustrated embodiment, a plurality of sleeves 194 extend proximally from the waist 222 down to the ankle 224 for permanently or removably receiving corresponding resistance elements therein. Preferably, the resistance elements may be removably carried by the garment, such as via an opening 226 illustrated at the superior end of sleeve 194, thereby enabling customization of the resistance level by the wearer. In addition, the resistance elements may preferably be removed for laundering the garment, and for taking the garment on and off. The garment can more easily be positioned on the body without the resistance elements, and the resistance elements may be introduced into the sleeve 194 or other receiving structure thereafter.

In addition, or as an alternative to the resistance elements disclosed previously herein, the garment may be provided with one or more elastic panels positioned and oriented to resist movement in a preselected direction. For example, an elastic panel having an axis of elongation in the inferior superior direction, and positioned behind the knee, can provide resistance to extension of the knee. Alternatively, a stretch panel on the front or anterior surface of the leg, spanning the knee, can bias the knee in the direction of extension and resist flexion. Panels 228 and 230 illustrated in FIG. 7 can be configured to stretch upon flexion of the knee thereby biasing the garment in the direction of extension. Resistance to flexion or extension or other movement of any other joint or motion segment in the body can be provided, by orienting one or more stretch panels of fabric in a similar fashion. In a passive resistance garment, the panels may comprise a plurality of wires or strands attached to or woven or braided into the fabric, as discussed below.

Any of a variety of fabrics may be utilized to form the garment, preferably materials which are highly breathable thereby allowing heat and moisture to escape, and having sufficient structural integrity to transfer force between the body and the resistance elements. The fabric can be compression or other elastic fabric, or an inelastic material with elastic panels in position to load specific muscle groups, or metal or metal-nonmetal hybrids depending upon the desired performance.

The woven resistance fabric of the present invention may comprise any of a variety of weaves typically between at least a first support filament and at least a second resistance filament. For example, the resistance fabric may comprise weaves such as plain weaves, basket weaves, rep or rib weaves, twill weaves (e.g., straight twill, reverse twill, herringbone twill), satin weaves, and double weaves (e.g., double-width, tubular double weave, reversed double weave). In general, the weave is a convenient structure for supporting a plurality of resistance imparting strands in a manner that can be made into or supported by a garment like structure that can be carried by a wearer's body. Nonwoven constructs can also be utilized, such as by securing a plurality of nonwoven (e.g., parallel) resistance strands (e.g., metal wire strands) to each other or to a supporting fabric base. Securing may be accomplished by dip coating, spray coating or otherwise coating or embedding the resistance strands with a flexible adhesive or other polymer, or weaving or braiding, to produce a flexible resistance band or sheet.

The term "strand" as used herein is a generic term for an elongate, thin flexible element suitable for weaving. For example, strands may include, but are not limited to monofilaments, filaments twisted together, fibers spun together or otherwise joined, yarns, roving yarns, crepe yarns, ply yarns, cord yarns, threads, strings, filaments laid together without twist, single strand or multi strand wire as well as other configurations. Strand includes elements sometimes referred to herein as rods, such that for example a 0.125 inch diameter copper rod is a relatively thick strand. Strand diameters will generally be at least about 0.018 inches, at least about 0.025 inches, at least about 0.040 inches, at least about 0.050 inches or at least about 0.10 inches or more, depending upon the construction and desired performance. For strands that are not circular in cross sections, the foregoing values can readily be converted to cross sectional areas as is understood in the art. Unless otherwise specified, references herein to strand diameters or cross sectional areas along the length of a strand or of a group of strands refers to an average value for the corresponding diameters or cross sectional areas.

A woven resistance fabric embodiment generally comprise at least a first and second sets of relatively straight strands, the warp and the weft, which cross and interweave to form a fabric. Typically, the warp and weft yarn cross at approximately a right angle as woven, but may cross at any angle such as at least about 45, 65, 75 or 85 degrees. Also typically, fabric is woven to have a given width, but may have any desired length. The warp yarn runs in the length direction of the fabric, which is generally the longer dimension thereof, and the weft yarn runs in the crosswise or width direction thereof, which is generally the shorter dimension. It may be convenient to weave passive resistance fabric such that the warp strand is a metal such as copper and the weft is a conventional athletic fabric material. The pants or body suit or resistance strips would be cut with the long axis of the resistance strands primarily running in an inferior-superior direction in the example of a pant, and the non-resistance strands run in a circumferential direction relative to the leg.

A textile and/or fabric may be woven in a single-layer weave and/or in a plural-layer weave. It is noted that textiles and/or fabrics having two or more layers, i.e. plural layers, are commonly and generally referred to as multilayer weaves. Certain weaves may be referred to specifically, e.g., a two-layer woven fabric may be referred to as a double weave. For example, an inner liner may be provided for comfort, to separate the wearer from the resistance layer.

In one embodiment of the present invention, a first warp or weft fibers may be aesthetic fibers that are selected for their aesthetic appeal (e.g., color, texture, ability to receive dye, drapeability, etc.). Examples of such fibers may include natural fibers, cotton, wool, rayon, polyamid fibers, modeacrylic fibers, high modulus fibers, Kevlar® fibers, Nomex® fibers, and other fibers formulated to produce or exhibit aesthetic characteristics.

A second warp or weft fibers may be performance fibers that are selected for their strength or protective properties (e.g., cut, abrasion, ballistic, and/or fire resistance characteristics, etc.). Examples of performance fibers include high molecular weight polyethylene, aramid, carbon fiber, Kevlar® fibers, Nomex® fibers, fiberglass, and other fibers formulated to produce or exhibit performance characteristics. Many performance fibers are not aesthetically desirable (e.g., don't receive dyes or colors well, etc.); however, by structuring a fabric in accordance with various embodiments of the present invention, traditional aesthetic problems associated with such fibers may have a significantly reduced effect given that such fibers are generally hidden from view.

A third warp or weft fibers may be comfort fibers that are selected for their comfort-providing qualities (e.g., softness against a wearer's skin, cooling properties, etc.). Examples of comfort fibers include cellulosic fibers such as cotton, rayon, wool, microfiber polyester, nylon, and other fibers formulated to produce or exhibit comfort characteristics.

In addition, the fibers that will extend around the leg and transverse to the metal fibers may be stretchable fibers that are selected to provide flexibility to the fabric to allow the fabric to have a better fit on the wearer and to allow the wearer more unrestricted movement while wearing the fabric. Examples of stretchable fibers include Lycra® fibers, Spandex® fibers, composite fibers that include Lycra® or Spandex® fibers, Kevlar® fibers, high modulus polyethylene, wool, rayon, nylon, mode acrylic fibers, and other fibers formulated to exhibit stretch characteristics.

Materials used for the shape memory element strands need only be biocompatible or able to be made biocompatible. Suitable materials for the shape memory element strands include shape memory metals and shape memory polymers. Suitable shape memory metals include, for example, TiNi (Nitinol), CuZnAl, and FeNiAl alloys. Particularly preferred are "superelastic" metal alloys. Superelasticity refers to a shape memory metal alloy's ability to spring back to its austenitic form from a stress-induced martensite at temperatures above austenite finish temperature. The austenite finish temperature refers to the temperature at which the transformation of a shape memory metal from the martensitic phase to the austenitic phase completes.

For example, martensite in a Nitinol alloy may be stress induced if stress is applied at a temperature above the Nitinol alloy's austenite start temperature. Since austenite is the stable phase at temperatures above austenite finish temperature under no-load conditions, the material springs back to its original shape when the stress is removed. This extraordinary elasticity is called superelasticity. In one example, Nitinol wire may be in the superelastic condition where the wire has been cold worked at least 40% and given an aging heat treatment at approximately 500 degrees Celsius for at least 10 minutes. The Nitinol wire is in its fully superelastic condition where the use temperature is greater than the austenite finish temperature of the Nitinol wire.

The term "elastic" is used to describe any component that is capable of substantial elastic deformation, which results in a bias to return to its non-deformed or neutral state. It should be understood that the term "elastic" includes but is not intended to be limited to a particular class of elastic materials. In some cases, one or more elastic portions can be made of an elastomeric material including, but not limited to: natural rubber, synthetic polyisoprene, butyl rubber, halogenated butyl rubbers, polybutadiene, styrene-butadiene rubber, nitrile rubber, hydrogenated nitrile rubbers, chloroprene rubber (such as polychloroprene, neoprene and bayprene), ethylene propylene rubber (EPM), ethylene propylene diene rubber (EPDM), epichlorohydrin rubber (ECO), polyacrylic rubber, silicone rubber, fluorosilicone rubber (FVMQ), fluoroelastomers (such as Viton, Tecnoflon, Fluorel, Aflas and Dai-El), perfluoroelastomers (such as Tecnoflon PFR, Kalrez, Chemraz, Perlast), polyether block amides (PEBA), chlorosulfonated polyethylene (CSM), ethylene-vinyl acetate (EVA), various types of thermoplastic elastomers (TPE), for example Elastron, as well as any other type of material with substantial elastic properties. In other cases, an elastic portion could be made of another type of material that is capable of elastic deformation or composite weaves of elastic and inelastic fibers or threads. In one exemplary embodiment, each elastic portion may include neoprene potentially augmented by a secondary elastic component such as sheets or strips of a latex or other rubber depending upon the desired elastic force and dynamic range of stretch.

Another fabric with a high modulus of elasticity is elastane, which is known in the art of compression fabrics. The material may be a polyester/elastane fabric with moisture-wicking properties. For example, the fabric may comprise 5 oz/yd.sup.2 micro-denier polyester/elastane warp knit tricot fabric that will wick moisture from the body and include 76% 40 denier dull polyester and 24% 55 denier spandex knit. The high elastane content allows for proper stretch and support. The fabric may be a tricot construction at a 60" width. The mean warp stretch may be 187% at 10 lbs of load, and the mean width stretch may be 90% at 10 lbs of load. This fabric also may have a wicking finish applied to it. Such a fabric is available from UNDER ARMOUR™ Although the foregoing fabric is given as an example, it will be appreciated that any of a variety of other fabric or other materials known in the art may be used to construct the garment 100, including compression fabrics and non-compression fabrics. Examples of such fabrics include, but are not limited to, knit, woven and non-woven fabrics comprised of nylon, polyester, cotton, elastane, any of the materials identified above and blends thereof. Any of the foregoing can be augmented with mechanical resistance elements, such as bendable rods, springs and others disclosed herein.

The fabric can be characterized by the total cross sectional area of metal per unit length of fabric, measured transverse to the direction of the metal strands. For example, a plain weave having parallel metal strands each having a diameter of 0.020 inches, each adjacent strands separated by 0.020 inches, will have a metal density of 25 strands per inch. The sum of the cross sections of the 25 strands is approximately 0.008 square inches.

The optimal metal density will depend upon garment design, such as whether the entire circumference of a leg is surrounded by hybrid fabric, or only discrete panels will include the hybrid fiber, the presence of any supplemental resistance elements, and the desired resistance provided by a given motion segment on the garment. In general, the metal density will be at least about 0.010 square inches of metal per running inch of fabric, and may be at least about 0.020, at least about 0.030 and in some implementations at least about 0.040 square inches of metal per inch. Most fabrics will have within the range of from about 0.020 and about 0.060 square inches of metal per inch of fabric, and often within the range of from about 0.025 and about 0.045 square inches per inch of fabric.

Referring to FIGS. 9A, 9B, 10 and 11, there is illustrated a side opening pant embodiment of the present invention which can support either resistance fabric, resistance rods or both types of resistance element. The pant 100 comprises a waist 102 which may be opened or closed or tightened by a fastener 104. Fastener 104 may be any of a variety of preferably low profile and comfortable adjustable fasteners such as Velcro or a belt buckle.

A right leg 106 comprises a resistance panel 108 and a side opening 110. The resistance panel runs from the waist to the ankle and may be made from or support a resistance fabric and or resistance strands. The resistance panel may have an average width measured in the circumferential direction around the leg of no more than about 2", sometimes no more than about 4" and often no more than about 6" or 8" so that it does not wrap all the way around the leg. Typically, the resistance panel will be oriented to run along the lateral side of the leg, although additional resistance panels may run along the medial side, the posterior or anterior or any one or combination of the foregoing, depending upon the desired performance.

The resistance panel may be constructed from a resistance fabric, or may have one or more panels of resistance fabric carried thereon. The resistance panels may also or alternatively be provided with at least one or two or three or four or more attachment structures or guides such as sleeve 109, for receiving a resistance element such as a malleable rod or other resistance element disclosed elsewhere herein. The sleeve may have a closed inferior end and an open or openable superior end, to removably receive the resistance element therein, so that the wearer can customize the resistance level as desired.

In the illustrated embodiment, the right resistance panel 108 is securely held against the leg by a plurality of straps 112 which extend across the opening 110. Each strap has a first end which is preferably permanently secured to the resistance panel 108, and a second end which may be releasably secured to the resistance panel such as by Velcro or other releasable fastener. The left and right legs are preferably bilaterally symmetrical.

The straps 112 preferably comprise a stretch fabric such as a weave with elastic fibers at least running in the longitudinal direction. One or two or three or more straps 112 may be provided both above and below the knee, to securely hold the resistance panel in place. Straps 112 may be oriented perpendicular to the long axis of the leg, or an angle as illustrated to provide a criss cross configuration.

Figure 12:
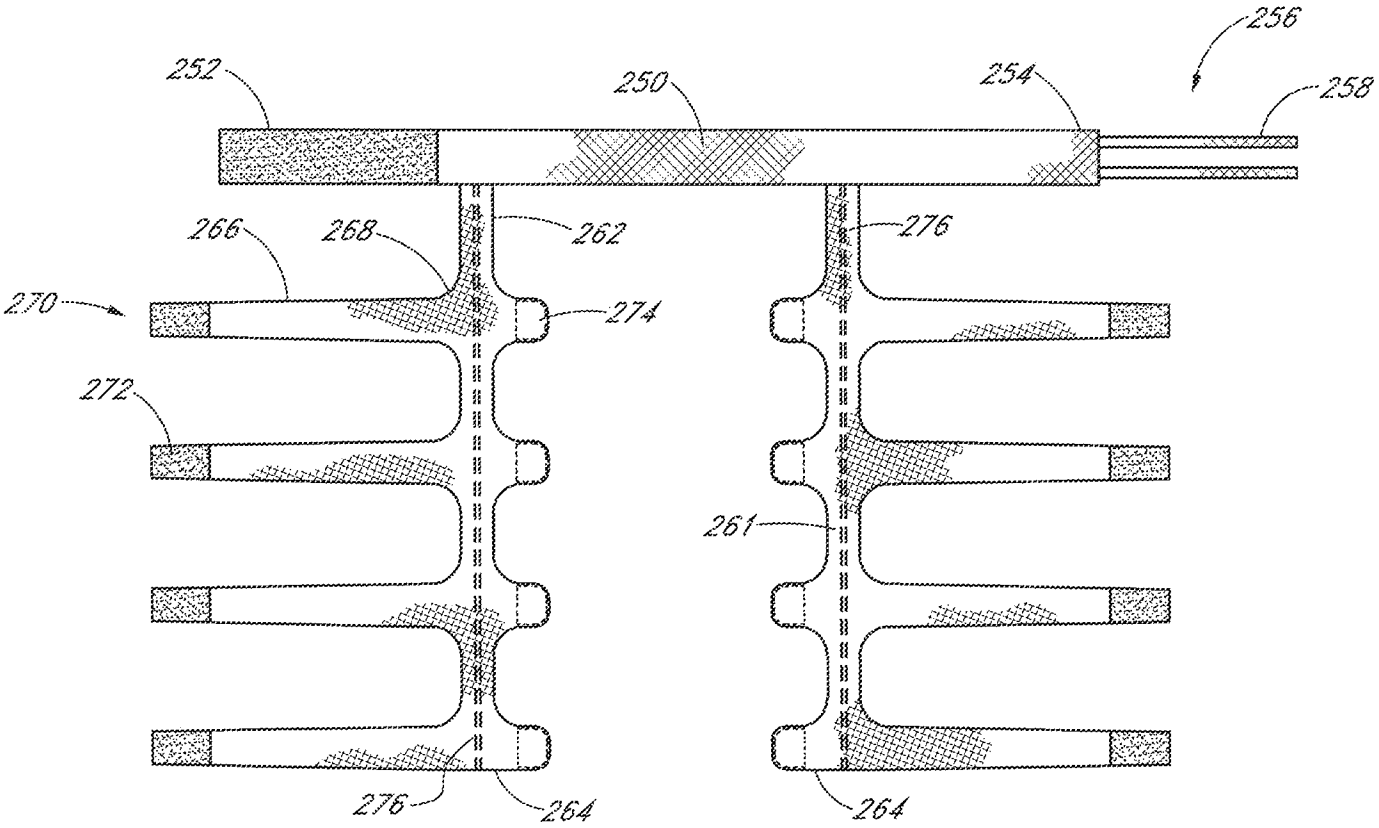
FIG. 12 is a flat plan view of an alternative resistance garment in accordance with the present invention.

Referring to FIG. 12, there is illustrated a flat pattern for a modified implementation of the invention. Waistband 250 extends between a left end 252 and a right end 254. A fastener 256 such as one or two or more Velcro straps 258 may be provided on either end of the waistband 250.

A left resistance panel 260 and right resistance panel 261 are attached to or formed integrally with the waistband and configured for attachment to the wearer's left and right legs, respectively. Attachment may be removable, such as by zippers as is discussed elsewhere herein. Left resistance panel 260 extends between a superior end 262 attached to the waistband 250 and an inferior end 264 which may be attached to the wearer below the knee such as in the vicinity of the ankle or to a shoe. A plurality of straps 266 are attached at one end 268 to the resistance panel 260 and a second free end 270 is configured so that the strap 266 can be wrapped around the wearer's leg and the free end 270 can be attached to the resistance panel 260 at an attachment zone 274 such as with Velcro or other fastener. In one implementation the free end 270 is fed through a buckle and looped back and attached to the strap 266, so that the strap can be easily tensioned as desired before fastening the fastener. At least about 4 or 6 or 8 or more straps may be provided for each leg, depending upon the materials used and the intended level of resistance that the garment will impose.

Each resistance panel can be made from a resistance fabric, or carry resistance fabric or other resistance element thereon. Alternatively, each resistance panel can be provided with attachment structures such as one or two or more connectors or sleeves for receiving resistance elements. In the illustrated embodiment, a first sleeve 276 spans both the hip and knee, and a second, shorter sleeve (not illustrated) spans the hip, for receiving copper rods or other resistance element. As discussed previously, the garment will generally impose a greater resistance across the hip than across the knee.

The resistance panel 260 may comprise both resistance fabric, as well as an attachment structure such as a sleeve for receiving a resistance element such as a solid or segmented rod or for the attachment of additional resistance panels. This enables wearer customization of the resistance level and profile of the garment.

Figure 13:
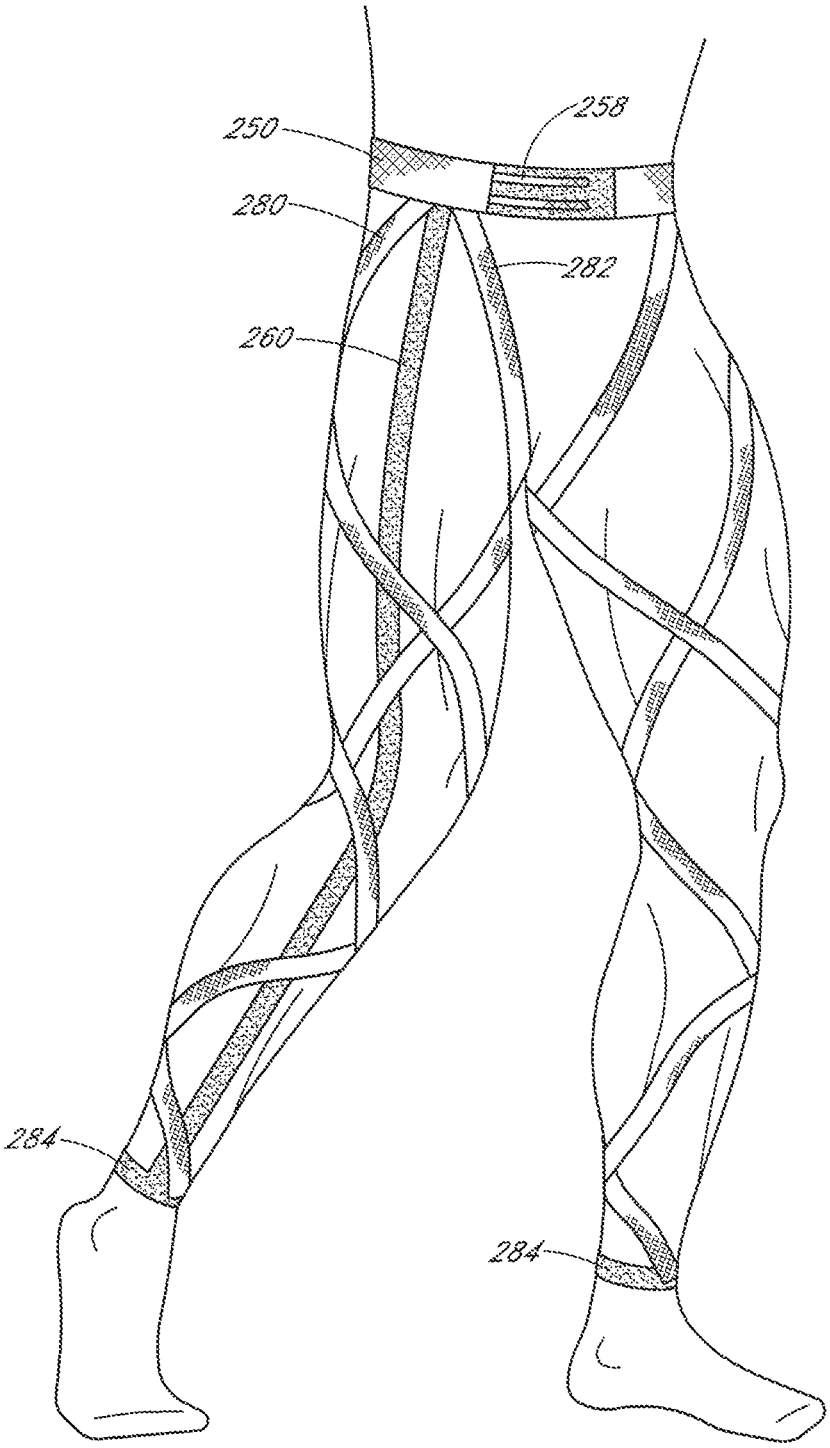
FIG. 13 is a perspective view of an alternative resistance garment in accordance with the present invention.
Figure 14:
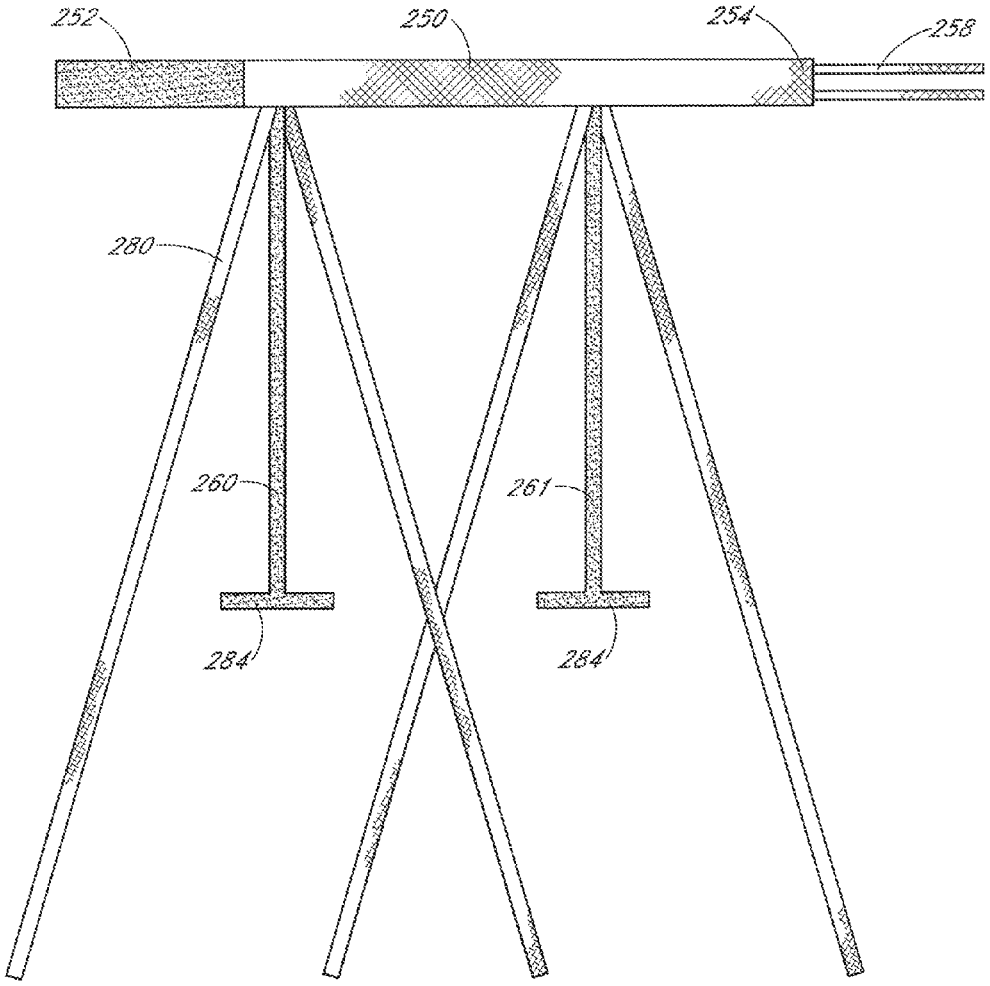
FIG. 14 is a flat plan view of the resistance garment of FIG. 13.

Referring to FIGS. 13 and 14, a resistance garment is shown having a waist or belt 250 and left and right resistance panels 260 and 261. In this implementation, the resistance panels may have an average width of no more than about 8 inches, no more than about 6 inches, no more than about 4 inches, no more than about 2 inches, or no more than about 1 inch depending upon whether resistance is generated by a fabric or other resistance element.

The left resistance panel is associated with at least a first strap 280 and as illustrated also a second strap 282 which are secured to the waist and or the resistance panel 260. As shown in FIG. 13, the first strap is wrapped helically around the leg and secured to the ankle by attachment to itself, or to the left resistance panel 260 or to an ankle strap 284 that may be provided at the inferior end of the resistance panel 260. The second strap 282 may then be wrapped helically around the leg in the opposite direction and secured to the ankle. At each of the crossing points between the straps 280 and 282 and the resistance panel 260 complementary Velcro panels align and create attachment points. Preferably the straps comprise stretch fabric to hold the resistance panel snugly in place yet accommodate moving musculature.

Figure 15:
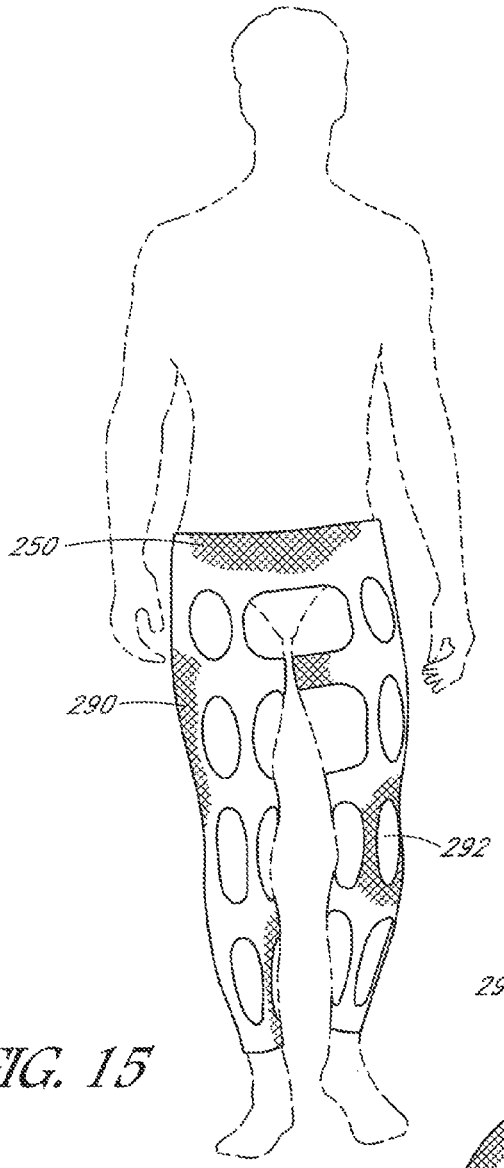
FIGS. 15 and 16 show an alternate implementation of the invention.
Figure 16:
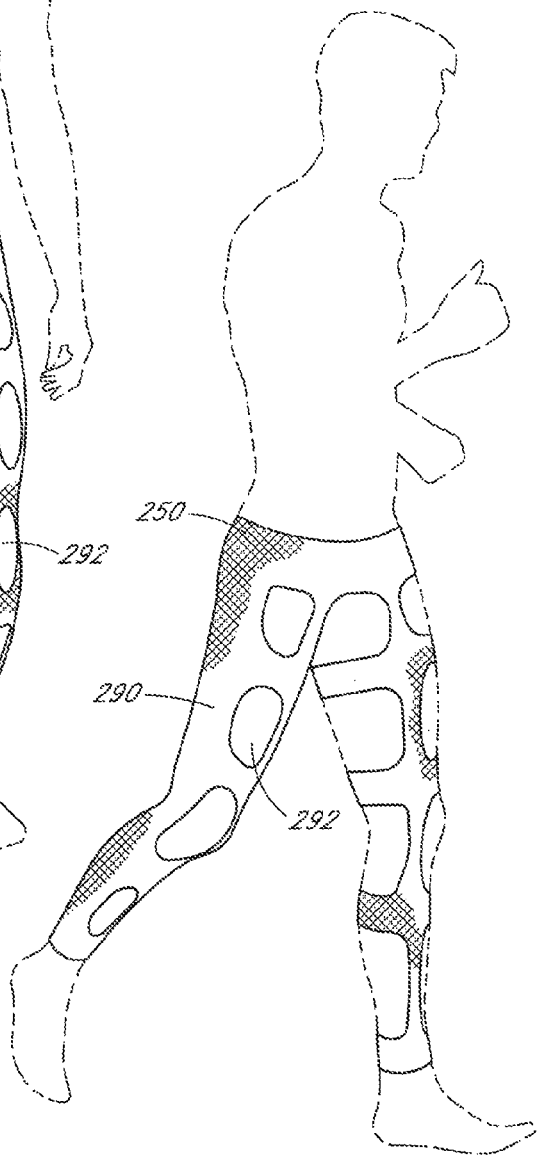

Another implementation is shown in FIGS. 15 and 16, in which a lateral resistance panel 290 is provided on each leg, as well as an anterior resistance panel 292. Anterior resistance panels may be provided with or without lateral or medial or posterior resistance panels depending upon the desired performance of the garment. While lateral or medial resistance panels will primarily bend in response to stride, anterior or posterior panels may both bend, as well as axially elongate and contract in response to stride.

Figure 17:
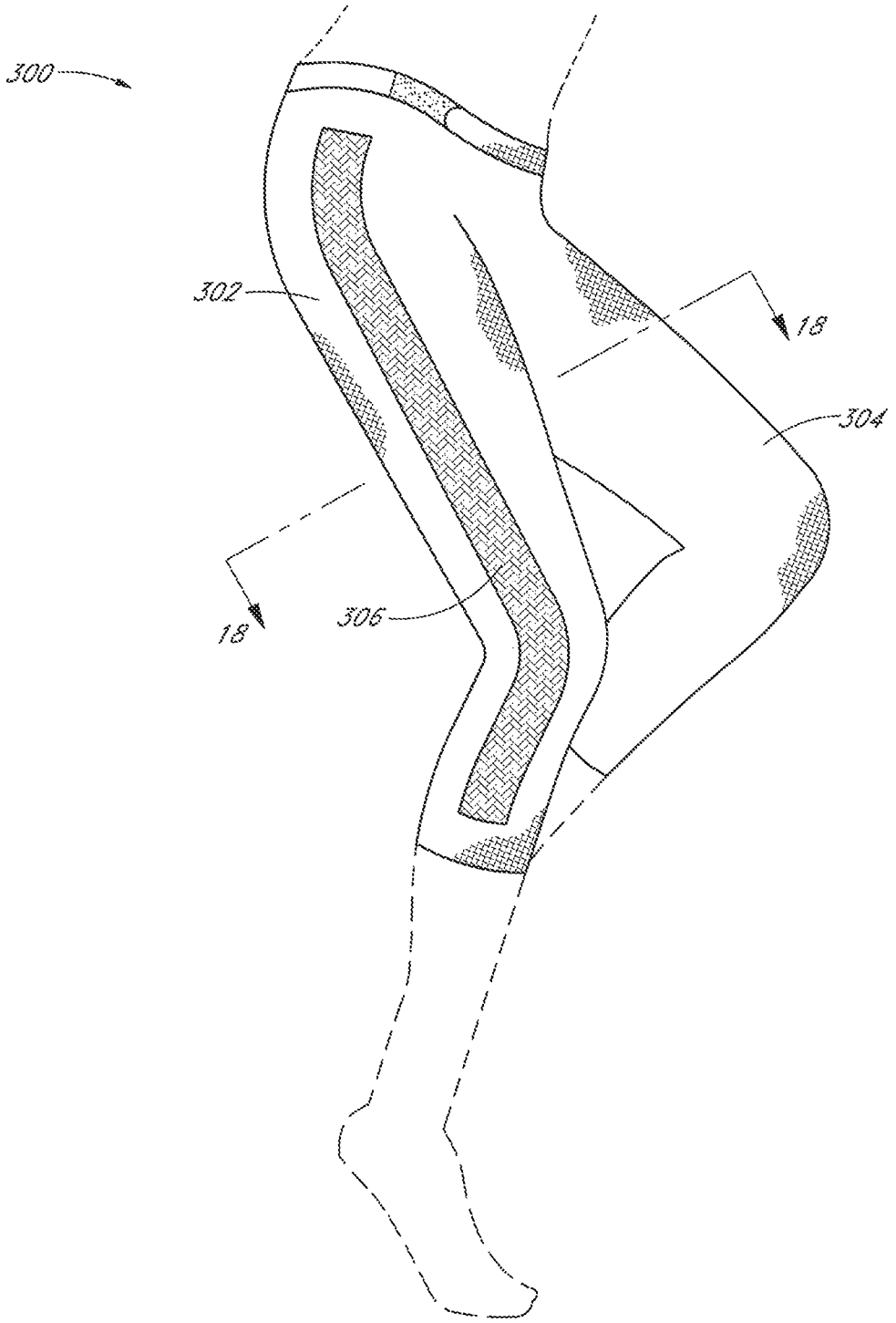
FIG. 17 is a side elevational view of a detachable component toning garment, having a resistance element extending in the inferior-superior direction.

Referring to FIG. 17, there is illustrated a toning garment 300 having a right leg 302 and a left leg 304. At least one resistance elements 306 is provided on each of the left leg 304 and right leg 302. In the illustrated embodiment, a single resistance element 306 is provided on each of the right and left legs, extending in an inferior-superior orientation on a lateral side of the leg, and spanning both the hip and knee. Resistance elements 306 may be provided on the lateral sides, the medial sides, or the lateral and medial sides of the leg. In this orientation, the bending of the resistance elements 306 is primarily in the anterior-posterior plane (in shear for a flat resistance element 306).

Alternatively, resistance elements 306 may be provided on the anterior or posterior or both aspects of the garment 300. Normal anatomical motion at the hip and knee would cause anterior or posterior resistance elements 306 to bend out of plane, and also to accommodate axial elongation and compression during the normal walking cycle. Thus, internal construction of anterior or posterior surface resistance elements 306 may be different than that utilized on a lateral or medial orientation.

Figure 18:
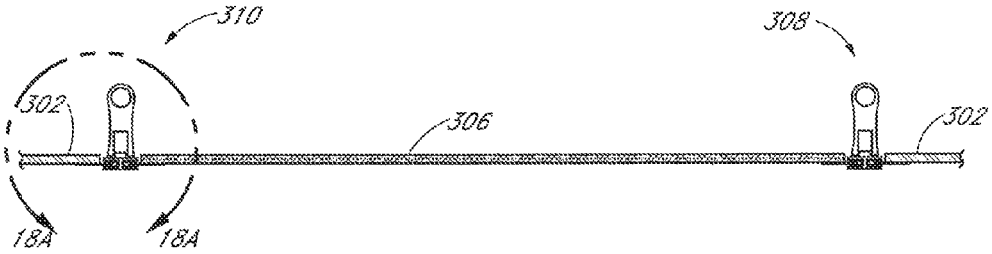
FIG. 18 is a cross-sectional view taken along the line 18-18 of FIG. 17, showing a removable resistance element secured to the garment.

Preferably, resistance elements 306 are removably secured to the garment 300. Referring to FIG. 18, removable attachment may be accomplished by providing a posterior attachment structure 308 secured to the right leg 302 and an anterior attachment structure 310 secured at an anterior orientation on the right leg 302. As with elsewhere herein, the devices of the present invention are preferably bilaterally symmetrical and only one side will generally be described in detail with the understanding that the other side will have a symmetrical configuration.

Figure 18A:
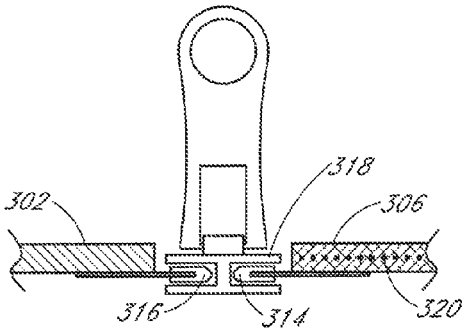
FIG. 18*a* is an enlarged view taken along the line 18*a*-18*a* of FIG. 18.

Each of the posterior attachment structure 308 and anterior attachment structure 310 are preferably attachment structures that permit secure attachment and removal of the resistance elements 306 to the garment 300. Referring to FIG. 18A, one exemplary attachment structure 308 is a zipper. A first plurality of teeth 314 may be secured along the length of the resistance elements 306 such as by stitching, adhesives, or other technique. First plurality of teeth 314 are configured to interdigitate or engage with a second plurality of teeth 316 secured along an edge which is attached to the toning garment 300. A slider 318 may be advanced up and down the inferior posterior direction, zipping and unzipping the resistance element 306 to the right leg 302.

Schematically illustrated in the resistance element 306 of FIG. 18A is a plurality of malleable strands 320, such as may be present in a wire fabric weave. However, any of the resistance elements described in the present application may be configured for interchangeable replacement with the resistance elements 306. Thus, the user of the toning garment 300 may select a resistance element out of an array of resistance elements, and releasable secure the resistance elements 306 to the garment 300. After a period of time, the resistance elements 306 may be removed from the toning garment 300 and replaced by a resistance element 306 having a different resistance characteristic. Alternatively, the resistance elements 306 may be removed and replaced by a resistance element having an identical resistance characteristic, such as following the useful life of the first resistance element.

A plurality of interchangeable resistance elements having different structures can be provided, such as metal wire, metal weaves, segmented resistance elements, pivotable resistance elements, open cell or closed cell foam, elastomeric materials such as silicone, latex or various blends of rubber, resistance elements having pulleys and wires, can be configured having an interchangeable mounting system and dimensions so that they may be interchanged on a single toning garment 300.

Figure 19:
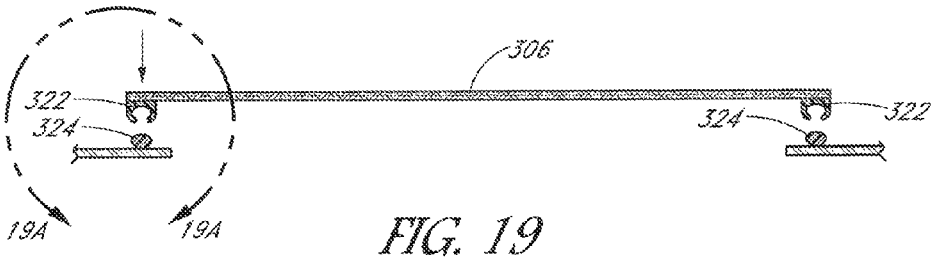
FIG. 19 is a cross-sectional view through a detachable component resistance element, showing an alternate attachment structure.
Figure 19A:
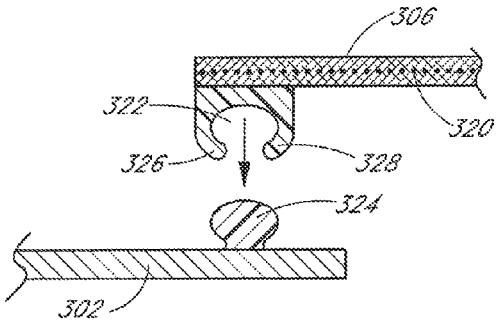
FIG. 19*a* is an enlarged view taken along the line 19*a*-19*a* in FIG. 19.

An alternative attachment structure comprises an elongate press fit attachment, that extends in the inferior superior axis, typically along the edges of the resistance elements 306. Referring to FIG. 19, one of the resistance elements 306 and corresponding locations on the garment 300 is provided with an elongate elastically deformable channel 322. The corresponding or complementary surface structure on the other of the resistance elements 306 or the garment 300 is an elongate bead 324. The elongate bead may be press fit into the elongate channel, like a zip lock fastener, to secure the resistance elements 306 in place. Press fitting the fastener to releasably retain the resistance elements 306 on the garment 300 may be accomplished by manual pressure, such as by running a finger along the length of the attachment structure.

Figure 20:
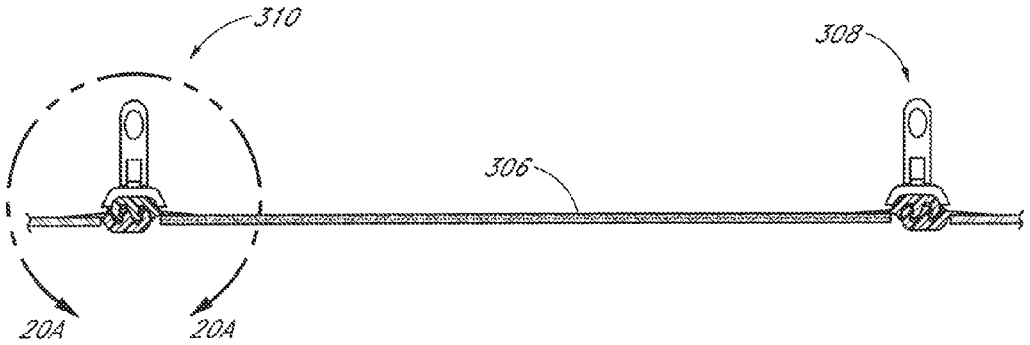
FIG. 20 is a cross-sectional view as in FIG. 18, showing an alternate attachment structure between the resistance element and the garment.
Figure 20A:
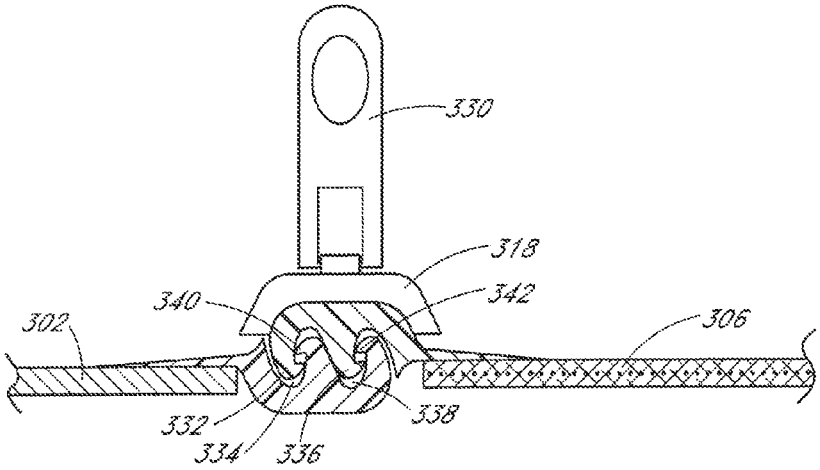
FIG. 20*a* is an enlarged view taken along the line 20*a*-20*a* in FIG. 20.

Alternatively, such as is illustrated in FIGS. 20 and 20A, a press fit embodiment may be secured and unsecured using a slider 318, typically having a pull tab 330. The implementation of the press fit fastener shown in FIGS. 20 and 20A provide a more robust connection between the resistance element 306 and garment 300. This may be desirable for implementations of the invention having relatively high resistance to movement, which will place greater tension on the attachment structure.

Referring to FIG. 20A, a first projection 332 attached directly or indirectly to the resistance element 306 or garment 300 it is removable received within a first recess 334 attached to the other of the resistance element 306 and garment 300. A second projection 336 is received within a second recess 338. A first pair of complementary engagement surfaces 340 is provided to create an interference fit within the first recess 334, and a second pair of complementary engagement surfaces 342 provide an interference fit within the second recess 338. This configuration can withstand a relatively high shear force such as might be experienced under tension, while at the same time enabling a relatively low release force such as by deformation of the pairs of complementary engagement surfaces as will be understood to those of skill in the art.

Figure 21:
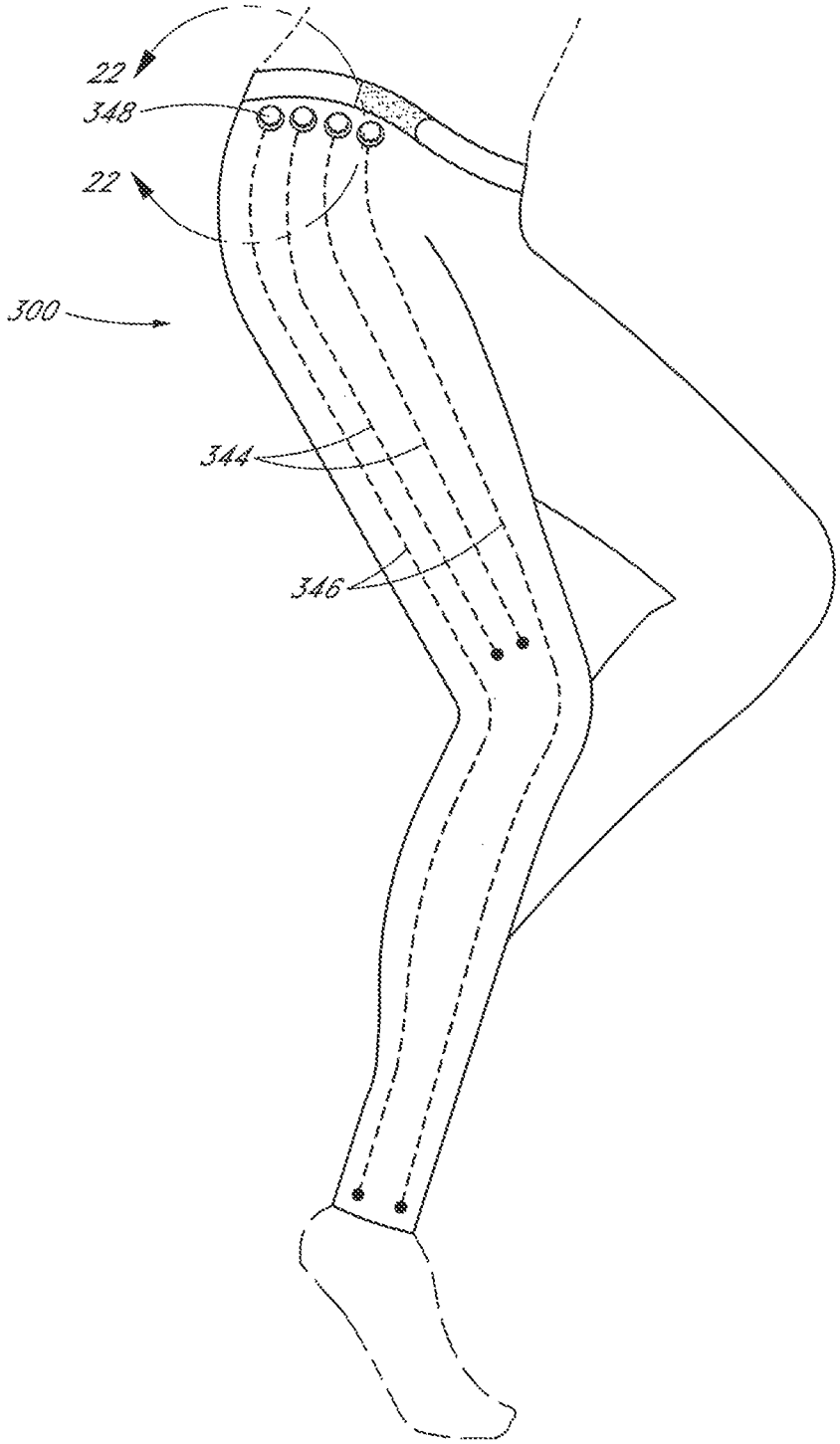
FIG. 21 is a side elevational view of an alternate toning garment in accordance with the present invention.

Referring to FIG. 21, there is illustrated a garment having a plurality of resistance elements, which happen in the illustrated embodiment to provide about twice as much resistance to rotation across the hip than the knee. This is accomplished by providing a first and second resistance elements 344 extending from about the waist to a point above the knee. A third and fourth resistance elements 346 extend from about the hip beyond the knee and preferably to approximately the ankle. The resistance elements may be any of a variety of structures disclosed elsewhere herein, including an adjustable or variable resistance element as will be discussed below.

The variable resistance element is convertible between a first disengaged configuration in which it is relatively freely flexible, and a second engaged configuration in which it provides a relatively higher resistance to bending. The disengaged configuration may enable a wearer to get into or out of the garment more easily with the resistance elements attached, or may enable the resistance element to be advanced through a sleeve or other retention structures on the garment with greater ease. Once a garment is properly positioned on the wearer, a control may be activated to convert the resistance element from the flexible, disengaged state to the engaged state, for use. In the embodiment illustrated in FIG. 21, a control 348 is illustrated for each of the resistance elements. However, a single control may be provided to simultaneously control at least 2 or 3 or all of the resistance elements, depending upon the desired performance.

The control 348 may be a knob, switch, lever, or any of a variety of structures depending upon the construction of the resistance element. In the illustrated embodiment, the control comprises a knob. The knob may be popped in or out along its axis of rotation to engage or disengage, and when engaged, may be rotated to tighten the resistance element.

Figure 22:
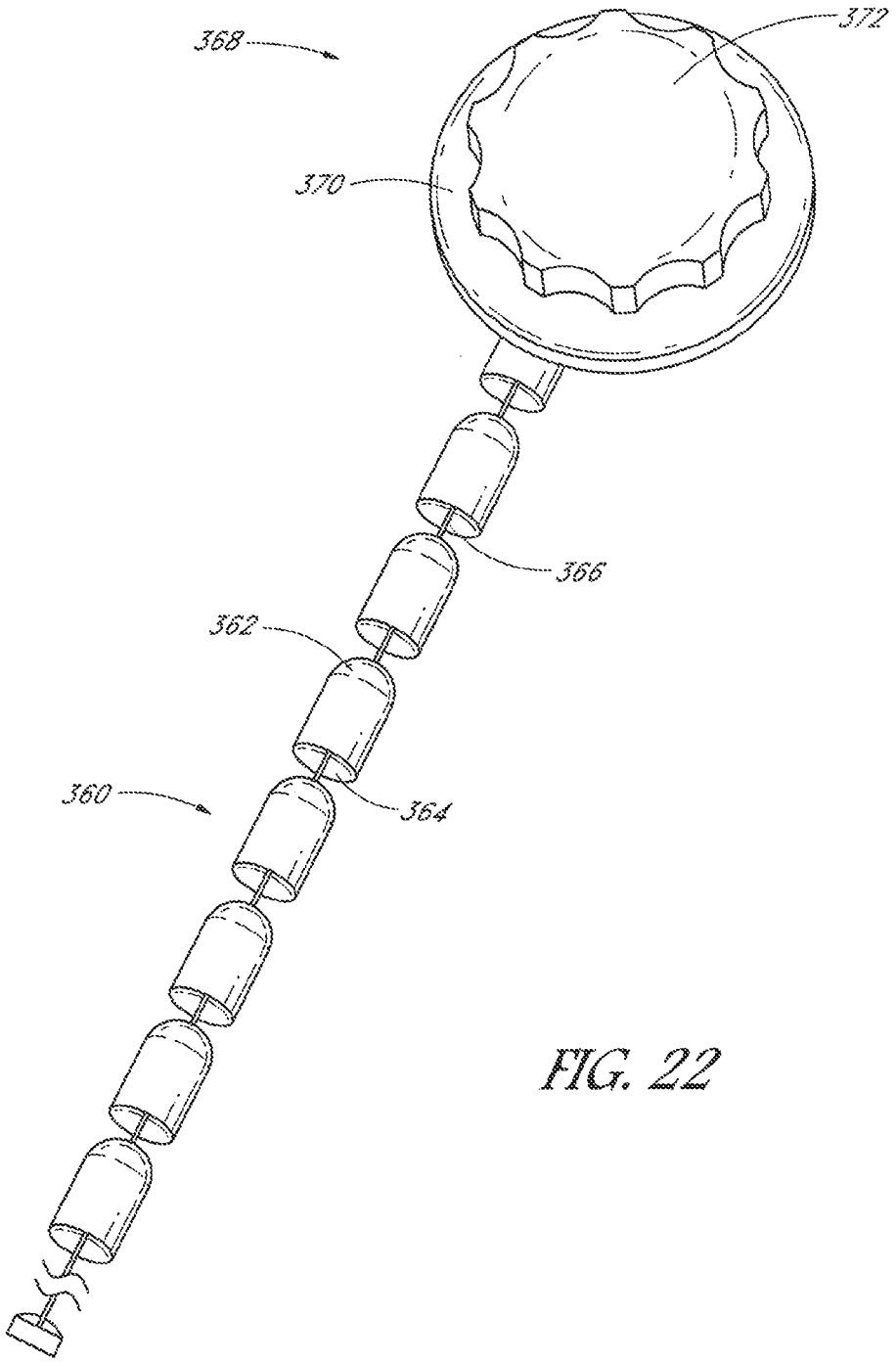
FIG. 22 is an exploded, perspective view of a segmented resistance element in accordance with the present invention.

Referring to FIG. 22, a segmented resistance element 306 is illustrated, of the type that may be utilized in FIG. 21. Resistance element 306 comprises a plurality of segments 360, each segment 360 having a proximal end 362 and a distal end 364. A central cannulation or lumen runs axially through each segment 360, to moveably receive a cable or pull wire 366. A plurality of at least about 5, generally at least about 10, and in some implementations at least about 20 or more segments 360 are carried by a single pull wire 366, and attached to a proximal control 368. Control 368 comprises a housing 370 having a winding mechanism (not shown) and a knob 372.

At least one of the proximal end 362 and distal end 364 of segment 360 is provided with a convex, preferably hemispherical or otherwise curved articulation surface. This articulation surface nests within a corresponding concavity on the adjacent segment 360, such that the two segments can angularly move with respect to each other while remaining nested.

In the illustrated embodiment in FIG. 22, the segments are shown in a relaxed or floppy state, with an excess of pull wire 366. Activation of the control such as by tightening the knob 372 pulls the pull wire 366 into the housing 370, applying axial compression to the various segments 360. Once under compression, the construct can only be bent laterally when the friction between adjacent nested surfaces is overcome. In this manner, tightening the knob 372 can provide resistance to bending over the resistance element.

The level of resistance to bending achieved by the embodiment illustrated in FIG. 22 can be modified in any of a variety of ways as will be understood in the art. For example, the level of polish or roughness of the articulating surfaces will directly affect the amount of force required to bend the resistance element once under tension. One or both of the convex and concave articulating surfaces may be provided with a texture, such as by etching or coating with a fine particulate material. Alternatively, certain materials inherently have differing levels of resistance. Segments 360 may be machined from metal, such as stainless steel, titanium, aluminum, or may be extruded or otherwise formed from a polymeric material. In some implementations of the invention, the segments 360 comprise nylon, polyethylene, PEEK, Teflon, or other materials known in the art.

Figure 23:
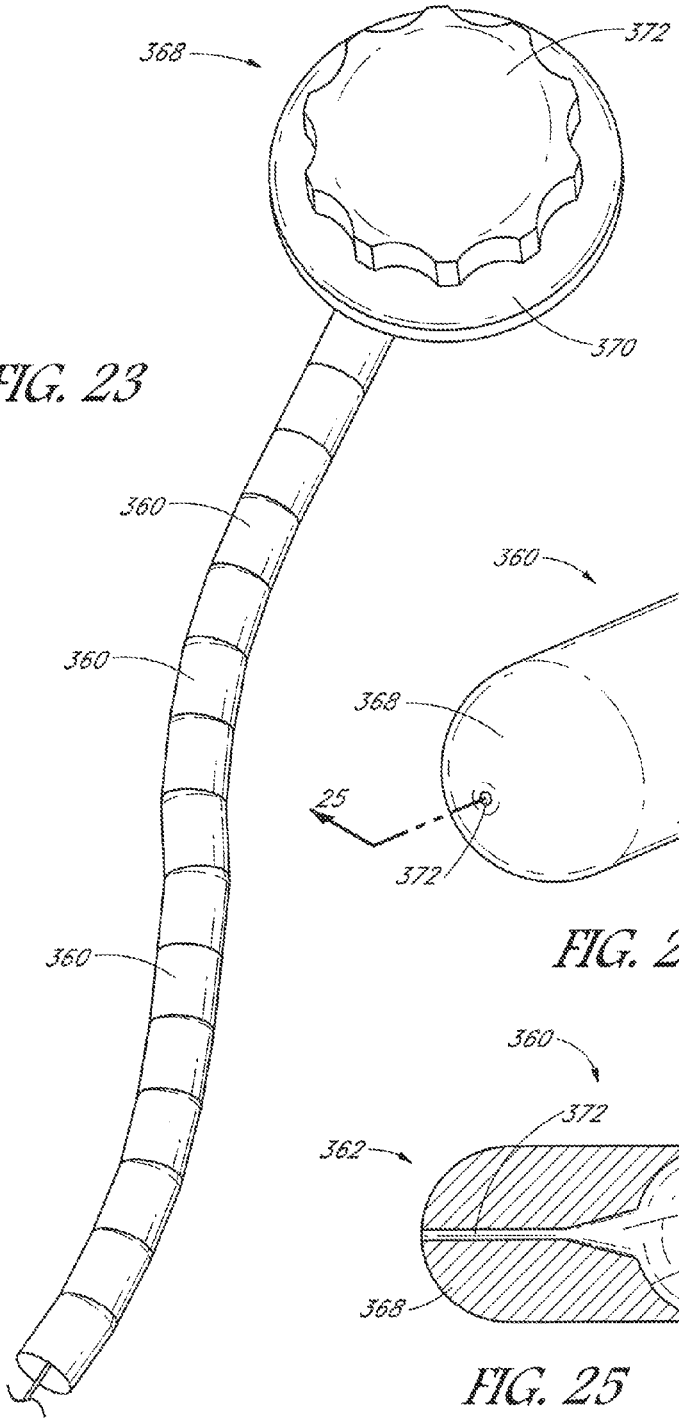
FIG. 23 is a perspective view of the resistance element of FIG. 22, shown with a plurality of segments under compression.

FIG. 23 shows the resistance element of FIG. 22, with the knob 372 rotated to lock the resistance element in the engaged configuration.

Figure 24:
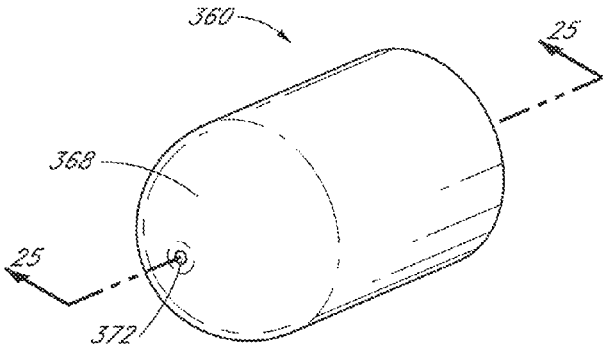
FIG. 24 is a perspective view of a single segment.
Figure 25:
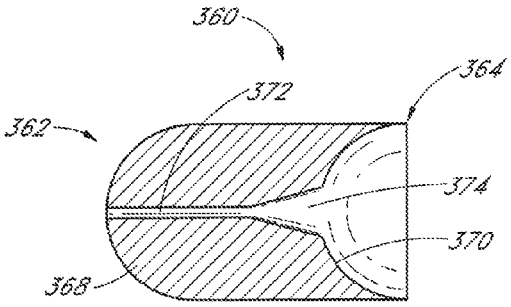
FIG. 25 is a cross-sectional view taken along the line 25-25 in FIG. 24.

Referring to FIGS. 24 and 25, an individual segment 360 comprises a proximal end 362 and distal end 364, although the orientation may be reversed. In the illustrated embodiment, proximal end 362 comprises a convex articulation surface 368 and a concave articulation 370. A central lumen 372 extends between the proximal end 362 and distal end 364, to moveably receive the pull wire 366 as previously discussed.

In order to accommodate sliding rotation of an adjacent pair of segments 360, the junction between the concave articulation surface 370 and lumen 372 is provided with a conical segment 374, to accommodate minor lateral movement of the pull wire 366 in response to bending of the resistance element. A conical flare may also be provided at the proximal end of the lumen 372.

Referring to FIGS. 26 through 29, there is illustrated an alternative segment 360. While the segments illustrated in FIGS. 22 through 25 enable deflection in 360°, the segments illustrated in FIGS. 26 through 29 are configured to substantially limit movement to within a single plane as will be appreciated by those of skill in the art.

Figure 28:
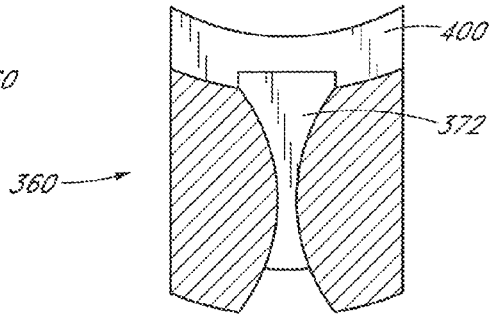

In the illustrated embodiment, a proximal end 362 of the segment 360 is provided with a beveled edge or keel 380. The geometries of the proximal and distal end can be readily interchanged, without changing the function of the resistance element. The beveled edge 380 is formed by a first bearing surface 382 and a second bearing surface 384 which incline medially in the proximal direction. The beveled edge 380 of a given segment 360 nests within a channel 386 of the adjacent segment 360. Channel 386 is formed by a first surface 388 and a second surface 400 which incline medially in a proximal direction. As will be appreciated by reference to FIGS. 26 through 29, a plurality of segments 360 under mild compression by pull wire 366 will permit lateral articulation of adjacent segments as the beveled edge 380 slides within channel 386 of the adjacent segment 360. The bearing surfaces may be provided with any of a variety of surface treatments, coatings, textures or materials to modify the sliding friction characteristics. As shown in FIG. 28, the central lumen 372 may be provided with a flared cross section in both the proximal and distal directions, to accommodate the pull wire during flexion and extension of the associated motion segment.

Figure 26:
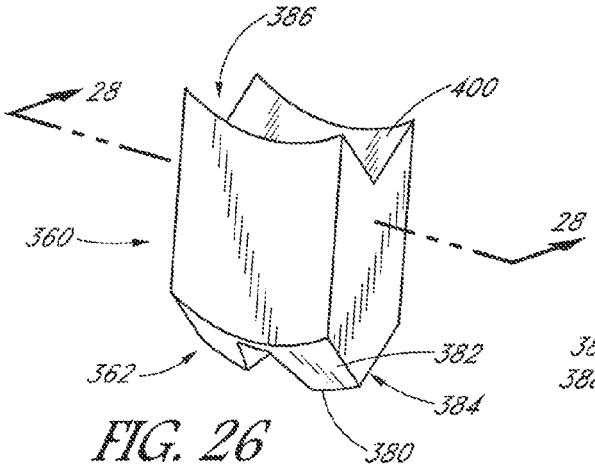
FIGS. 26-29 illustrate flat or rectangular segments in accordance with the present invention.
Figure 27:
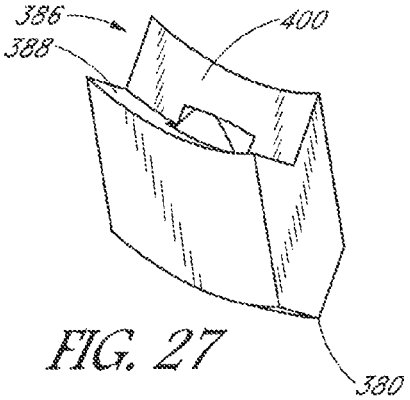
Figure 29:
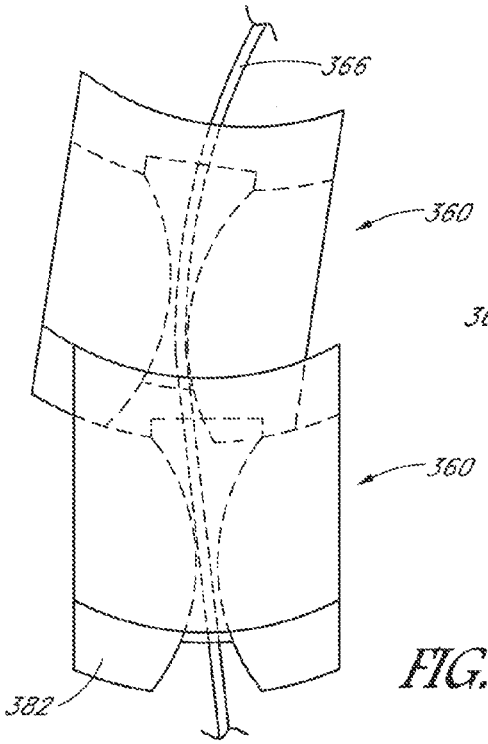

The flat or rectangular segment 360 illustrated in FIG. 26 thus substantially limits movement to flexion or extension within plane, or in shear. For this reason, resistance elements utilizing the segments of FIGS. 26 through 29 are preferably mounted on the lateral or medial sides of the garment.

Figure 30:
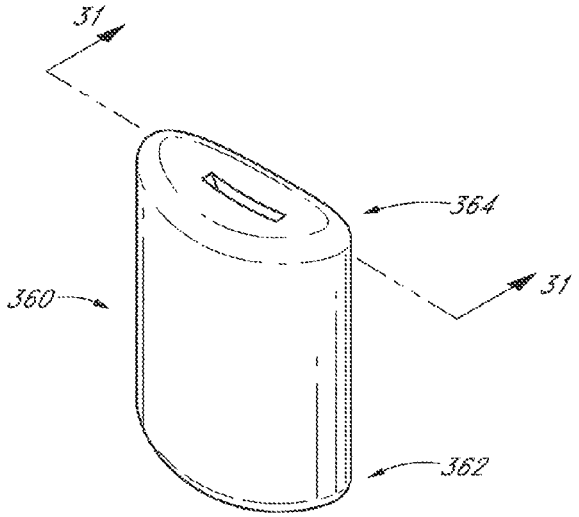
FIGS. 30-32 illustrate oval segments in accordance with the present invention.
Figure 32:
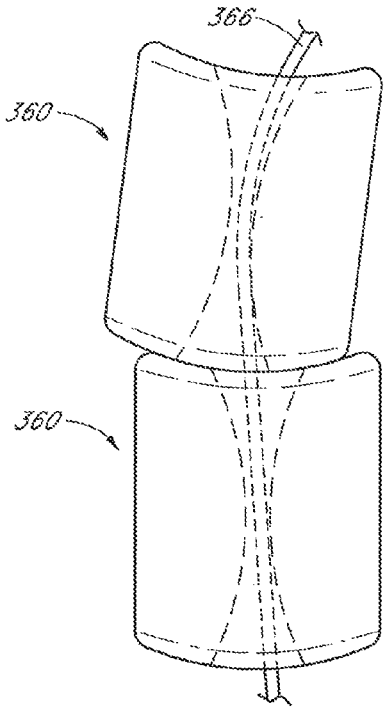
Figure 31:
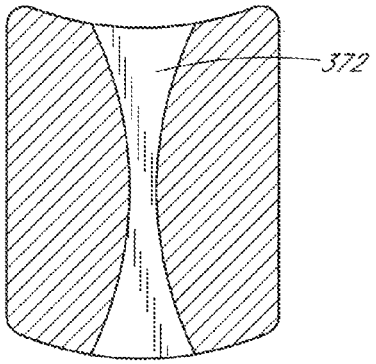

The segment 360 may alternatively be provided with a substantially oval or rounded configuration, as illustrated in FIGS. 30 through 32.

Figure 33:
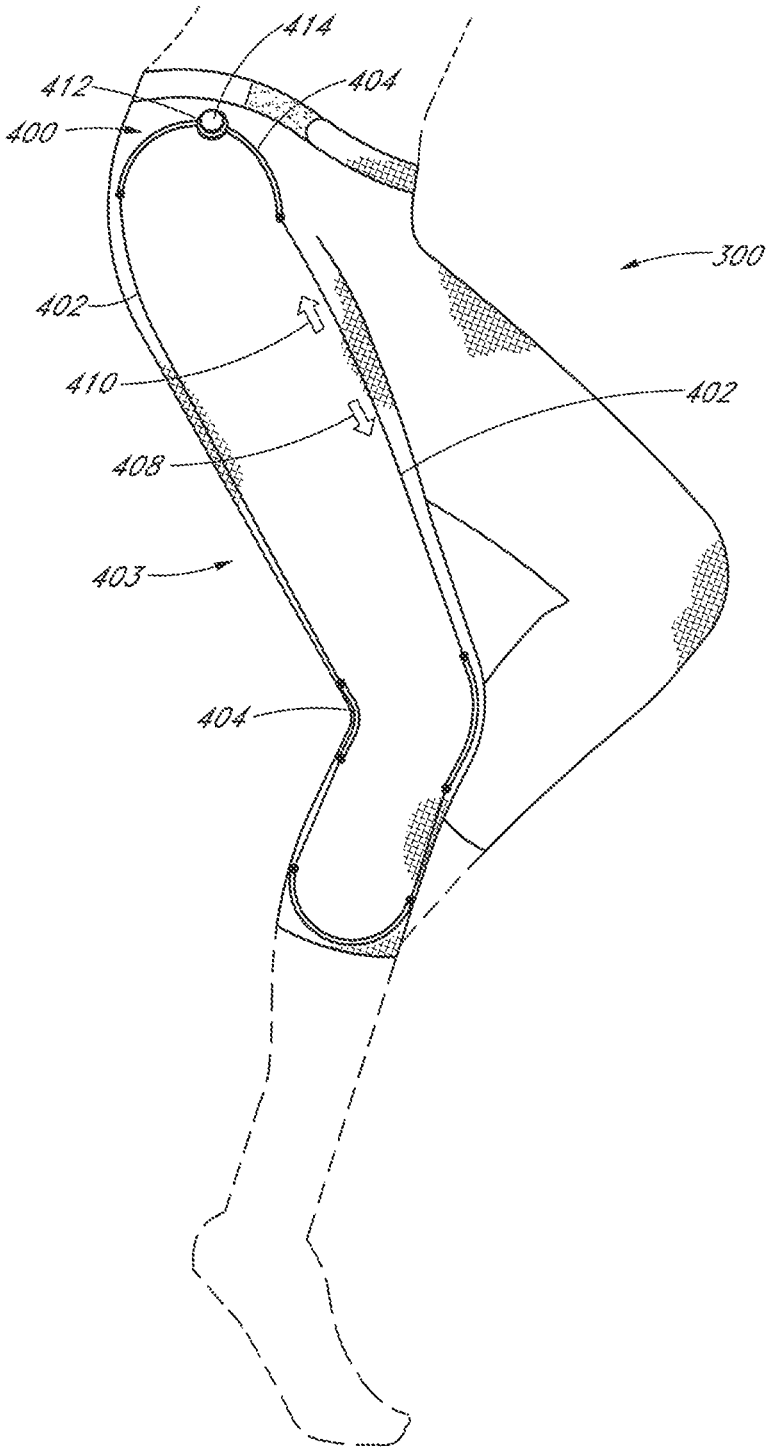
FIG. 33 is a side elevational view of a pulley and/or cable embodiment of a resistance system in accordance with the present invention.

Referring to FIG. 33, there is illustrated a schematic view of a cable system 400. As used herein, the term cable refers to any of a variety of elongate flexible elements, which exhibit relatively low elongation under tension in the intended use environment. The cable may comprise a single stand or multi-strand construct, comprising string, polymeric filament or metal wire. The cable may be woven, braided or twisted, in a multi-strand embodiment, which may have more desirable flexibility characteristics than a single strand cable. Metal cables may comprise any of a variety of materials, such as stainless steel, or preferably Nitinol.

In the illustrated embodiment, a cable 402 extends up the posterior surface 403 of the garment, through a guide structure such as guide to 404, and back down the anterior surface of the garment. The posterior and anterior aspects of the cable may be joined at the inferior limit, to form an endless loop, or may otherwise be anchored or secured with respect to the garment. The superior aspect of the cable 402 is freely sideable through the guide tube 404. In this manner, the anterior aspect of the cable will move in a first direction 408 under flexion, and a second direction 410 under extension.

Resistance to movement is provided by adding resistance to movement of the cable 402 within its path. Resistance may be accomplished simply by the tortuosity or characteristics of the cable path, including the guide tubes 404. Alternatively, a resistance element 412 may be provided within the cable path, such as at the superior aspect as illustrated. The resistance element may comprise any of a variety of mechanisms for controllably resisting movement of the cable therethrough, such as compression of a brake element against the cable 402. Brake element may comprise a surface having a material such as nylon, Teflon, polyethylene or other brought into compression against the cable such as by an adjustable screw. Alternatively, the cable may wind around a drum, and the drum may include any of a variety of resistance brakes, or gear trains, including a fly wheel, to provide controlled resistance to the cable moving therethrough. The pulley or drum which rotates in response to reciprocal movement of the cable may be utilized to turn a generator, which can be utilized to charge a battery or capacitor or drive an electronic device. This allows the wearer to recapture some amount of mechanical energy in the form of electrical energy.

The path of the cable 402 can take any of a variety of configurations as will be understood by those of skill in the art. As has been previously discussed, the resistance across the hip may desirably be greater than the resistance across the knee, which may make it desirable to have two or more cable loops per leg as will be apparent in view of the disclosure herein. Guide tubes 404 or other guide structures such as pulleys, pins, pegs, fabric sleeves or the like may be provided and arranged as appropriate for a particular garment design. The resistance element may provide a preset resistance level, determined at the point of manufacture. Alternatively, the resistance element may be provided with a knob 414 or other control permitting user adjustability of the resistance level. Adjustability may be accomplished by tightening or loosening the compression of a brake shoe against the cable, or using a clutch structure such as the mechanism in a "star drag" feature well understood in the fishing reel arts.

Figure 34:
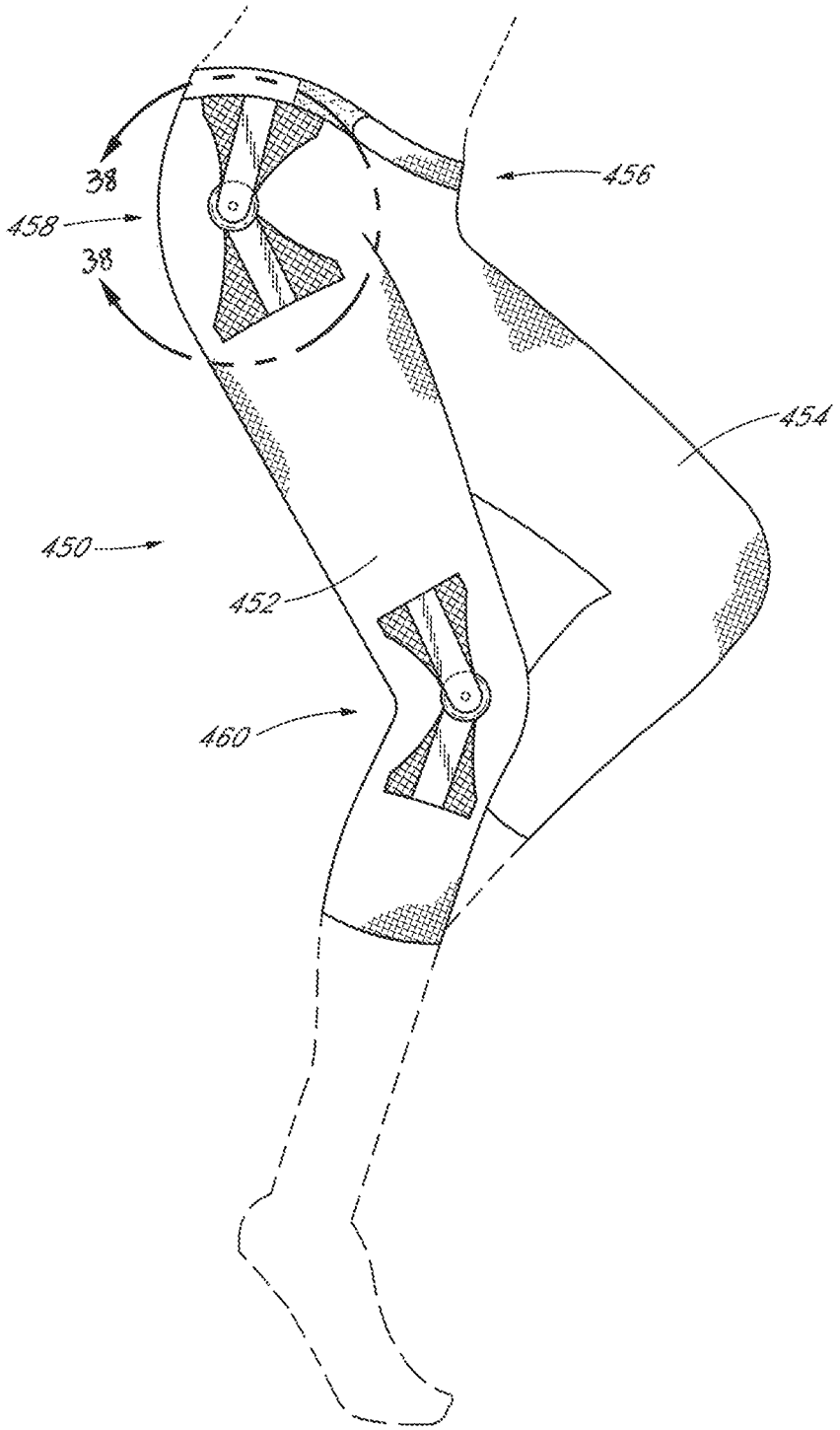
FIG. 34 is a side elevational view of a toning garment showing a right hip and a right knee resistance unit.

Referring to FIG. 34, there is illustrated a further toning garment 450 in accordance with the present invention. The toning garment 450 includes a right leg 452, a left leg 454, and a waist 456. The toning garment 450 will preferably be bilaterally symmetrical. Accordingly, only a single side will be discussed in detail herein.

In the illustrated embodiment, the right leg 452 is provided with a hip resistance unit 458. Right leg 452 is additionally provided with a knee resistance unit 460. Each leg of the toning garment 450 may be provided with either the hip resistance unit 458 or the knee resistance unit 460, with or without the other. The left and right hip resistance units will preferably have an axis of rotation that is functionally aligned with a transverse axis of rotation which extends through the wearer's left and right hip axes of rotation. Functional alignment includes precise alignment however due to the different fit that will be achieved from wearer to wearer, precise alignment may not always occur. Due to the stretchability of the garment, minor misalignment may self correct or not present adverse performance. Similarly, the knee resistance units, if present, will preferably have an axis of rotation that is functionally aligned with the transverse axis of rotation that extends through the center of rotation of each knee.

Figure 35:
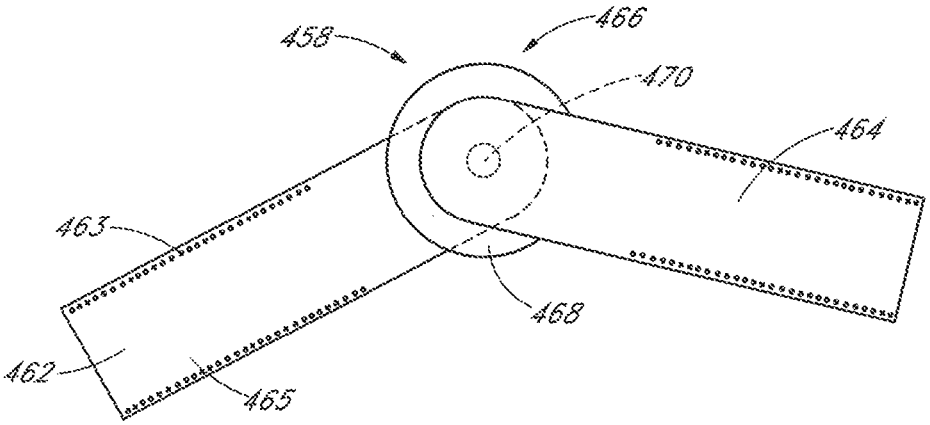
FIG. 35 is a plan view of a toning garment resistance unit.

Referring to FIG. 35, the hip resistance unit 458 will be described in further detail. The left leg hip resistance unit, and both the right and left leg knee resistance unit 460 may be constructed in a similar manner.

The hip resistance unit 458 is provided with a first attachment such as a first lever 462, and a second attachment such as a second lever 464 connected by a pivotable connection 466. The pivotable connection 466 comprises a resistance element 468 which provides resistance to angular movement between a primary longitudinal axis of first lever 462 and a primary longitudinal axis of second lever 464. In the as worn orientation, the axis of rotation 470 is substantially aligned with an axis of rotation of the joint with which the resistance element is associated.

A lever as used herein refers to a structure that mechanically links a housing or rotatable component of a resistance unit to a portion of the garment or wearer at or above and below the resistance unit, so that movement of the wearer is resisted by the resistance unit. The lever may take a conventional form, as illustrated in FIG. 35, and comprise an elongate element having a length generally at least about 2 inches, in some embodiments at least about 4 or 6 or 8 inches to provide better leverage and attachment force distribution. The element may a have a width of at least about 0.25 inches, and in some embodiments at least about 0.5 inches or 1.0 inches or 2 inches or more but normally less than about 3 inches or 2.5 inches. The thickness may be less than about 0.25 inches, preferably less than about 0.125 inches and in some embodiments less than about 0.50 inches. The lever may comprise any of a variety of washable, non corrosive materials such as nylon, Teflon, polyethylene, PEBAX, PEEK or others known in the art. Preferably the lever arm is sufficient to transmit force in the anterior-posterior direction in the case of hip and knee resistance units, but is flexible in the medial-lateral direction to enable the garment to follow the contours of the body.

Figure 41:
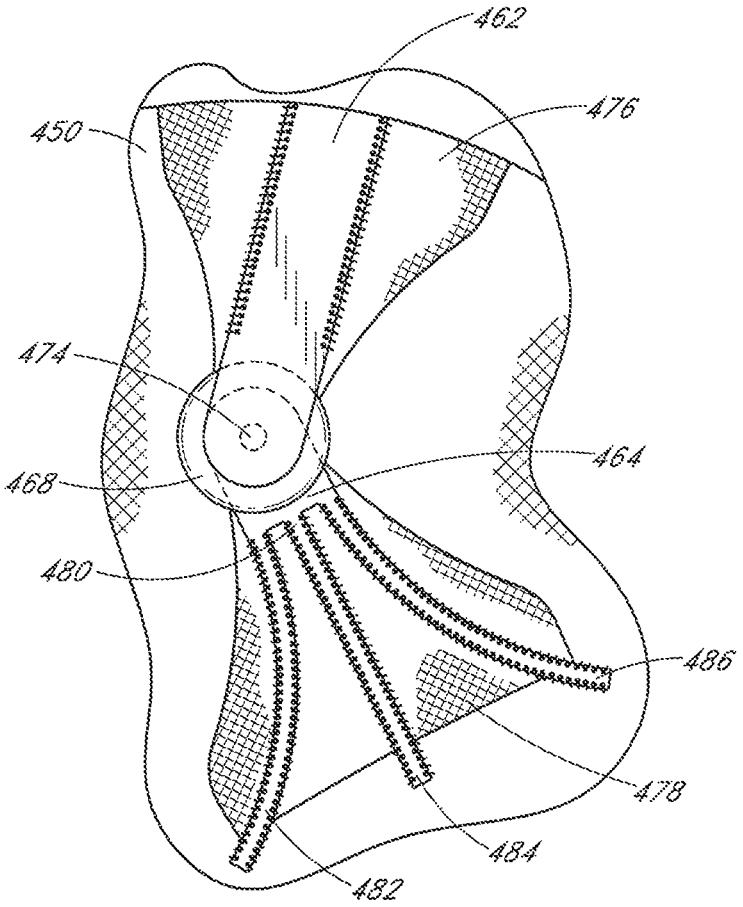
FIG. 41 is a resistance unit secured to a garment, showing an alternative reinforced attachment configuration.

The lever may alternatively comprise a hub for attachment to the resistance unit, and a plurality of two or three or four or more elements that are secured such as by stitching or adhesive bonding to the garment. See FIG. 41 in which a hub 480 supports at least an anterior element 482, a medial element 484 and a posterior element 486. Each of the elements is preferably relatively inflexible in the anterior-posterior direction, but flexible in the medial-lateral direction to enable the anterior element 482 to wrap at least partially around the side and optionally around the front of the leg. The posterior element 486 preferably wraps at least partially around the posterior side of the leg. The lever elements can be configured as a system of straps similar to the straps 280 and 282 (FIG. 13). The elements can comprise one or more strands or technical fabric supports, sufficient to transmit the forces involved in a given garment and resistance unit system.

The hip resistance unit 458 may be secured to the toning garment 450 in any of a variety of ways. in the illustrated embodiment, the first lever 462 is provided with at least a first set of apertures 463 and optionally a second set of apertures 465 to receive a filament such as a polymeric or fabric thread, for sewing the hip resistance unit 458 to the garment. Stitching may alternatively be accomplished by piercing the first lever 462 directly with the sewing needle, without the need for apertures 463 or 465. Alternatively, the first lever 462 can be secured to the garment using any of a variety of fastening techniques, such as adhesive bonding, grommets or others known in the art.

The superior and inferior attachment structures at the hip are not necessarily the same. A lever is convenient for the inferior attachment, to distribute force along a portion of the length of the femur. The longitudinal axis of the first, superior attachment at the hip may be transverse to the longitudinal axis of the second lever 464, such that the first lever is aligned like a belt, circumferentially extending along a portion of or approximately parallel to the wearer's waist. Alternatively, the housing of the resistance element may be sewn or adhesively bonded or otherwise attached directly to reinforced fabric at the hip.

The resistance element 468 may be any of the resistance elements disclosed elsewhere herein. In one embodiment, resistance element 468 may comprise a rotary damper. At the hip, the rotary damper may be rated to provide anywhere within the range of from about 5 inch pounds to about 50 inch pounds torque. Generally, in a toning garment, torque at the hip may be in the range of from about 10 inch pounds to about 30 inch pounds, and often no more than about 20 inch pounds. For the athletic training market, higher torques such as at least about 25 inch pounds, and some implementations at least about 35 or 40 inch pounds or higher may be desirable.

Torque at the knee will generally be less than at the hip. Values of at least about five or 10 inch pounds, but generally less than about 25 or 20 or 15 inch pounds may be desirable in a toning garment at the knee. As discussed elsewhere herein, the resistance element at any given joint can provide the same or different resistance (including zero) upon flexion or extension.

Referring to FIGS. 36-37 and 39-40, the resistance element 468 may comprise a generally disc shaped housing, having a diameter of less than about 4 or 3 or 2.5 inches, and a thickness in an axial direction of less about 0.75 and preferably less than about 0.5 inches. A connector 472 is rotatably carried by the housing 468. Connector 472 may be a post or an aperture, having a non-circular (e.g. square, hexagonal, triangular, circular with at least one flat side) cross-section such that a complementary post or aperture may be axially positioned in engagement with the connector 472, to transmit rotational torque.

Figure 36:
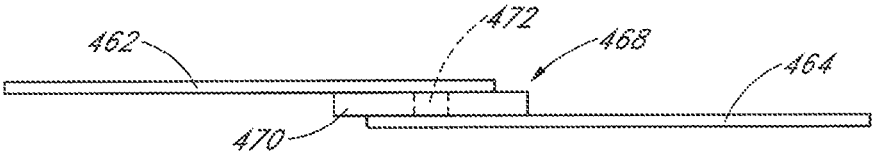
FIG. 36 is a side elevational view of the resistance unit of FIG. 35.

Referring to FIG. 36, the resistance element 468 housing maybe secured to either the first lever 462 or the second lever 464. The connector 472 may be secured to the other of the first lever 462 and second lever 464. Resistance element 468 thus provides resistance to motion of the first lever 462 with respect to the second lever 464, throughout an angular range of motion about the axis of rotation 470.

Figure 37:
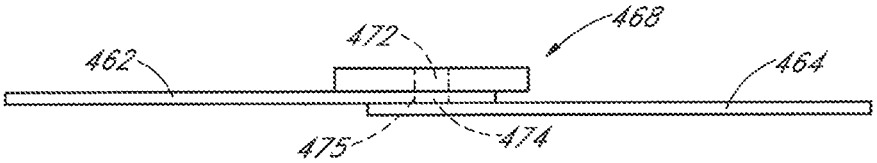
FIG. 37 is a side elevational view of an alternate configuration of the resistance unit of FIG. 35.

In an alternative configuration, the levers may be mounted on the same side of the resistance element 468 to provide an overall lower profile. Referring to FIG. 37, Second lever 464 is provided with a post for rotationally engaging the connector 472. Post 474 extends through an aperture 475 in the first lever 462. Aperture 475 has a diameter that exceeds the maximum transverse dimension of the post 474, such that post 474 may rotate without imposing any force on first lever 462. The housing of resistance on 468 is immovably secured with respect to first lever 462.

Figure 38:
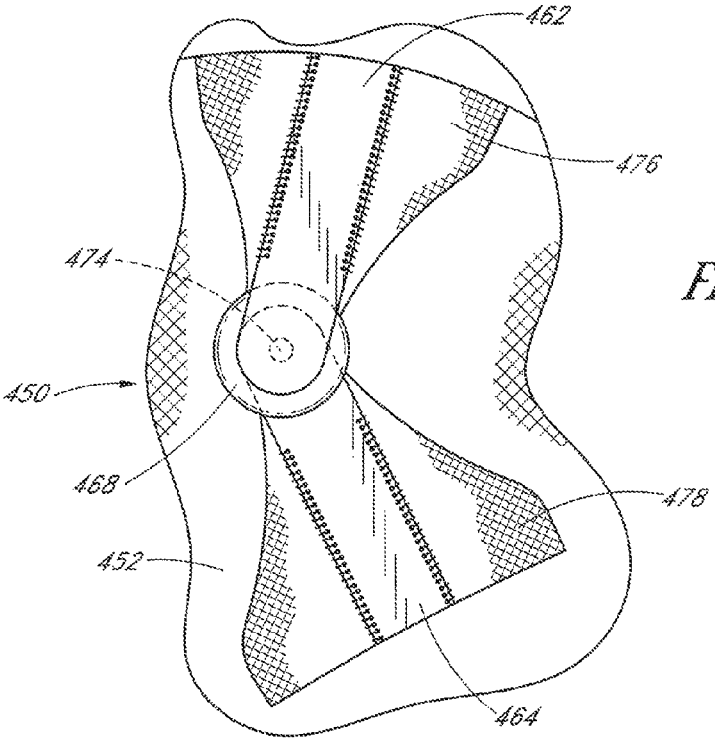
FIG. 38 is a resistance unit as in FIG. 35, attached to a garment with force distribution fabric layers.
Figure 39:
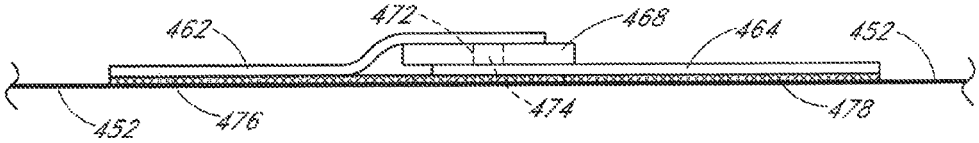
FIG. 39 is a side elevational view of the resistance unit and garment assembly of FIG. 38.
Figure 40:
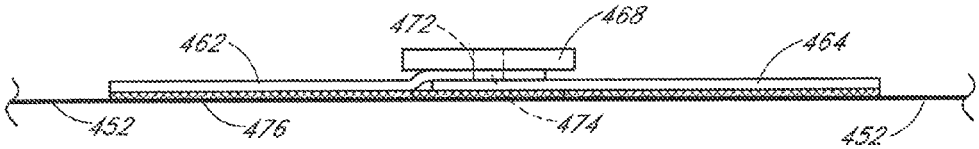
FIG. 40 is a side elevational view of an alternate configuration of the resistance unit and garment assembly of FIG. 38.

Referring to FIG. 38, a hip resistance unit 458 is illustrated as secured to a garment 450 although the following description also applies to resistance elements at the knee. Depending upon the configuration of the lever arms, the stretchability of the fabric, and the level of resistance imposed by resistance element 468, one or more reinforcement or force transfer or dissipation features may be necessary to transfer sufficient force between the lever arm and the garment, while minimizing stretching or wrinkling of the garment. In the illustrated embodiment, first lever 462 is additionally provided with a first force dissipation layer 476. Force dissipation layer 476 may comprise any of a variety of fabrics, such as those disclosed previously herein and below in connection with FIG. 44. In one implementation, the fabric comprises one or more strands of yarn or filament having a vector extending in the as worn anterior posterior direction which exhibits relatively low stretch. Force dissipation layer 476 may be attached to the edges of first lever 462 such as by stitching, adhesives or other fastener, and extend in the anterior posterior direction beyond the edges of the first lever 462 to provide an attachment zone both anteriorly and posteriorly of the first lever 462. The attachment zones may be secured to the underlying garment by stitching, adhesives or both, or other fasteners known in the art.

The first force dissipation later 476 may extend beneath, within the same plane, or across the outside surface of the first lever 462, entrapping the first lever 462 between the force dissipation layer 476 and the garment 450.

The force dissipation layer is preferably a technical fabric weave, comprising any of a variety of strands identified previously herein. Preferably the fabric has stretch resistance along at least one axis, which can be aligned with an axis under tension during flexion or extension due to the resistance element. The fabric may exhibit a higher level of stretch along other axes. The fabric also preferably exhibits low weight, high breathability and high flexibility. Some suitable fabrics include shoe upper fabric from running shoes including, for example, that disclosed in US patent publication No. 2014/0173934 to Bell, the disclosure of which is incorporated by reference in its entirety herein. Additional multilayer fabrics having good flexibility, and stretch resistance along one axis and higher stretch along a transverse or nonparallel axis, useful for the force dissipation layer are disclosed in U.S. Pat. No. 8,555,415 to Brandstreet et al; U.S. Pat. No. 8,312,646 to Meschter et al; and U.S. Pat. No. 7,849,518 to Moore et al., the disclosures of each of which are incorporated in their entireties herein by reference.

Rotary dampers (sometimes called dashpots) suitable for use in the present invention are precision fluid damping devices which give a smooth resistance to shaft rotation which increases with angular velocity. Either of two types of dashpot may be used with the present invention, in view of the reciprocating, limited range of motion associated with the human stride. Vane dashpots give a restricted travel and high damping rate particularly suitable for reciprocating motions. Continuous rotation dashpots give less damping rate but unlimited travel which is useful but not necessary in the context of the toning and training garments of the type, for example, illustrated in FIG. 34. Continuous rotation dashpots may be desirable in certain constructs, such as in connection with an embodiment of FIG. 33, in which resistance element 412 includes a rotary damper which may rotate through more than one full revolution per stride in each direction depending upon the pulley diameter and potential gear configurations.

Silicone fluid (Polydimethyl Siloxane) is a suitable damping medium because of its stable viscous properties. Dashpots are normally vacuum filled and sealed for life, and the housing or coatings on the housing can comprise materials having good corrosion resistance in the intended use environment. That environment includes repeated exposure to salinity and other content of perspiration as well as detergents and other solutes utilized in conventional clothes washing machine cycles.

The vane dashpot is a displacement damper. As the vane or piston on the shaft rotates between one or more fixed vanes or barriers on the body, silicone fluid is displaced through controlled clearances from one side of the fixed barrier to the other. Damping can be in both directions or valves can be fitted to give damping in one direction only. Thus, for example, the hip or knee or both may be provided with resistance in both directions or against anterior motion (like walking through waist deep water) but no resistance or low resistance against posterior motion. Continuous rotation dashpots give viscous damping by shearing thin layers of silicone fluid between the concentric surfaces of a rotor and a fixed stator. Damping can be adjusted by varying the effective thickness of the sheared layer of fluid by moving the stator relative to the rotor, or in the case of dampers that utilize electro-rheological fluid (ERF) or magneto-rheological fluid (MRF), changing the viscosity of the fluid.

In an MRF damper, micron-sized, magnetically polarized particles are suspended in a carrier fluid such as silicone oil or mineral oil. MRF is capable of responding to an applied magnetic field in a few milliseconds. The material properties of an MRF can change rapidly by increasing or decreasing the intensity of the applied magnetic field. The material property can be viewed as a controllable change in the apparent viscosity of the fluid by varying the current supplied to, for example, an adjacent electromagnet. A higher fluid apparent viscosity can be exploited to provide a higher damping force or pressure-drop across an MRF valve.

Energy to drive the electromagnet and associated electronics can be supplied by a battery, solar cells, or an on board generator to scavenge electricity from body heat or motion. In one implementation, a rotational generator may be carried by the garment and driven by rotational movement at the hip or the knee or both. A control may be provided to allow the wearer to toggle between a low resistance and a high resistance mode, or to also adjust the resistance to intermediate values as desired.

Figure 42:
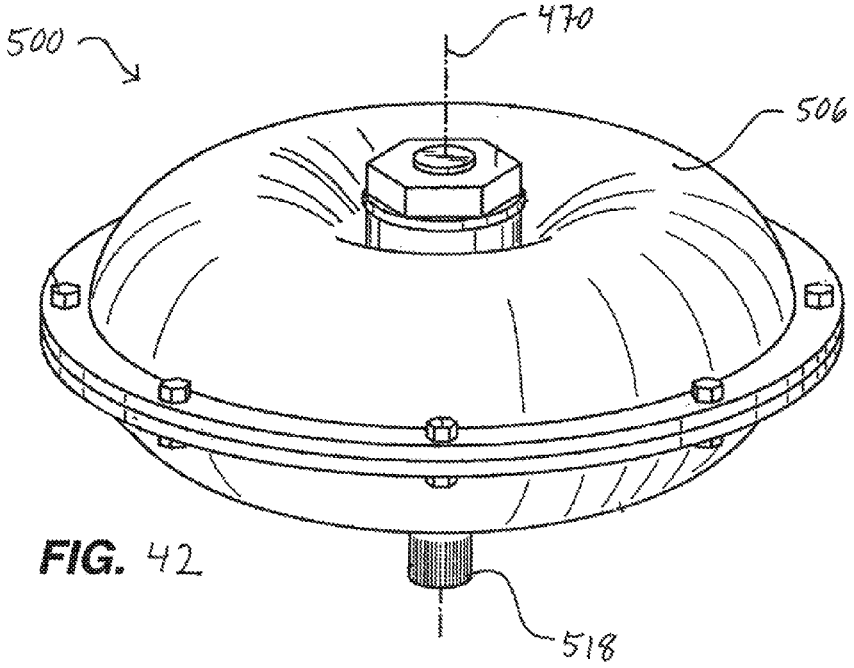
FIG. 42 is an enlarged, perspective view of a rotary damper useful in the present invention.
Figure 43:
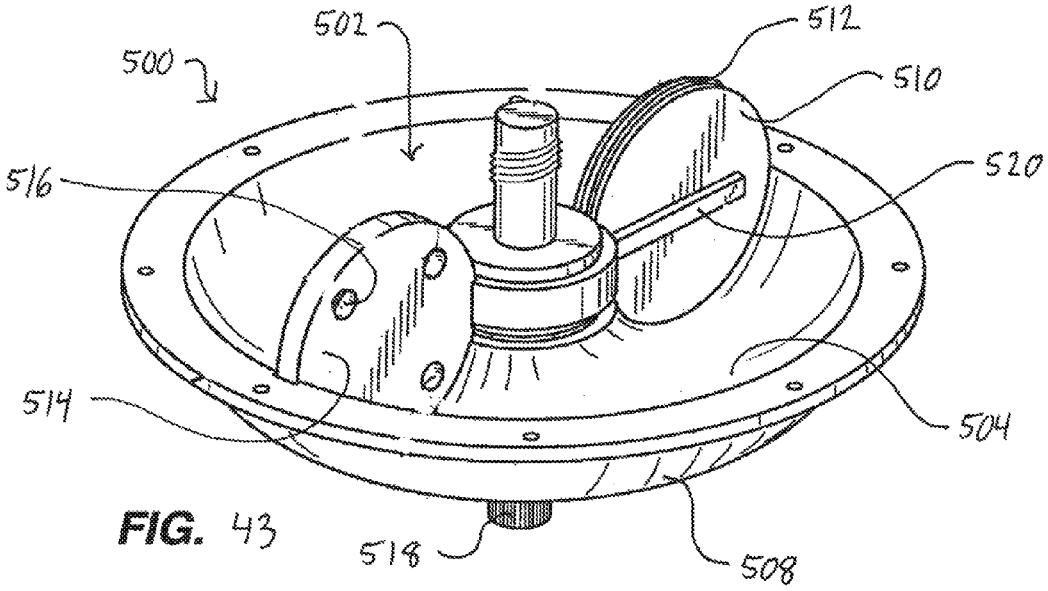
FIG. 43 is a perspective view of the rotary damper of FIG. 42, with a portion of the housing removed.

Referring now to FIGS. 42-43, a rotary damper is illustrated. The apparatus includes a housing 500 defining a housing interior 502 for containing damper fluid (not shown) of any conventional nature. The housing interior has a substantially circular cross section and is formed by a toroidal (illustrated) or cylindrical inner housing surface 504 disposed about and spaced from a central axis 470. The housing 500 includes two adjoining housing members 506, 508, each housing member defining a portion of the housing interior.

A vane or piston 510 having a substantially circular-shaped outer peripheral piston surface at which is located an outer seal 512 is in substantially fluid-tight, slidable engagement with the toroidal inner housing surface, spaced from axis 470 and disposed along a common plane with the axis 470. The housing 500 and the piston 510 are relatively rotatably moveable about the axis, as will be described in greater detail below.

A fluid barrier 514 in the form of a plate is immovably attached to the housing and positioned in the housing interior.

The fluid barrier 514 defines multiple flow control orifices or passageways 516 which permit restricted passage of damper fluid therethrough responsive to relative rotational movement between the piston 510 and the housing to dampen forces applied to the apparatus causing the relative rotational movement.

A shaft 518 extends through the housing interior along axis 470 and projects outwardly from at least one opposed side of the housing, the shaft passing through openings of the housing.

Piston 510 is secured to shaft 518 such as by radially extending arm 520 affixed to shaft. Relative rotational movement between the housing and the shaft 518 causes the piston 510 to rotate about axis 470. This will cause damper fluid in the housing interior to pass through flow control passageways 516 and thus resist the relative rotational movement.

Any of a variety of alternative specific damper constructions may be utilized as will be apparent to those of skill in the art. Linear dampers may also be used, along with associated lever arms, or mounted in line in a pulley system such as that illustrated in FIG. 33.

Figure 44:
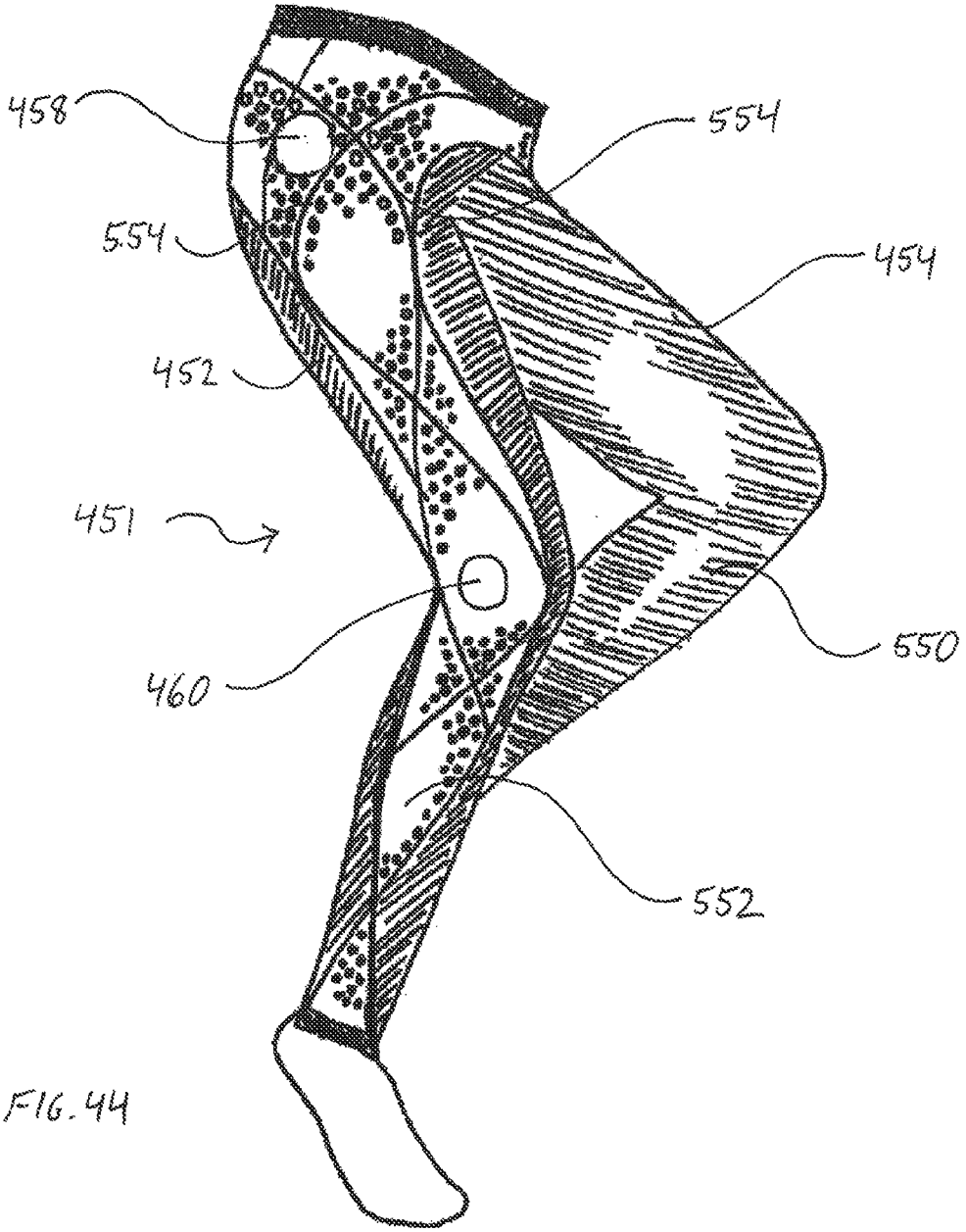
FIG. 44 is a side view of an athletic training garment incorporating the resistance units and technical fabric features of the present invention.

Referring to FIG. 44, there is illustrated a training garment 451 having a right leg 452 and a left leg 454. The training garment 451 is similar to the toning garment 450 shown in FIG. 34, although may have more technical fabric and potentially higher or different resistance characteristics.

The training garment preferably comprises at least one stretch panel 550, for providing a snug fit and optionally compression. The panel may exhibit stretch in at least a circumferential direction around the leg and waist. Stretch panel 550 may comprise any of a variety of fabrics disclosed elsewhere herein, such as for example in connection with FIG. 38. The panel may include woven textile having yarns at least partially formed from any of polyamide, polyester, nylon, spandex, wool, silk, or cotton materials, for example. More particularly, the yarns may be eighty percent polyamide and twenty percent spandex in some configurations. When formed from a combination of polyamide and spandex, for example, the stretch woven textile may exhibit at least thirty percent stretch prior to tensile failure, but may also exhibit at least fifty percent or at least eighty percent stretch prior to tensile failure. In some configurations of garment 451, the stretch in stretch woven textile may equal or exceed one-hundred percent prior to tensile failure. The optimal amount of stretch will normally be the maximum stretch that still allows the wearer to move comfortably with maximum force transfer between the wearer's movement and movement of the resistance units. Too much stretch in a direction of force imposed by the resistance unit will allow the fabric to stretch rather than transfer all of the wearer's motion to the resistance unit.

At least one and in some implementations at least two or three or more technical fabric support panels 552 are provided on each of the right and left legs, to facilitate force transfer between the wearer and the hip resistance unit 458 and, when present, the knee resistance unit 460. The technical support panel 552 may be provided with at least one and normally a plurality of reinforcement strands 554 extending along a pattern to facilitate force transfer and maintaining fit of the garment throughout the range of motion in opposition to the resistance provided by the resistance unit. The technical fabric support panel 552 may be positioned over the entire height of the garment (as illustrated) or may be localized in the vicinity of the resistance units.

Yarns extending along a non stretch or low stretch axis within non-stretch woven textile panel may be at least partially formed from any of polyamide, polyester, nylon, spandex, wool, silk, cotton or other high tensile strength strands disclosed herein. Depending upon the materials selected for the yarns, non-stretch woven textile may exhibit less than ten percent stretch prior to tensile failure, but may also exhibit less than five percent stretch or less than three percent stretch at least along the non stretch axis prior to tensile failure.

A plurality of different panels of each of stretch woven textile and non-stretch woven textile may be joined to form garment 451. That is, garment 451 may have various seams that are stitched or glued, for example, to join the various elements of stretch woven textile and non-stretch woven textile together. Edges of the various elements of stretch woven textile and non-stretch woven textile may be folded inward and secured with additional seams to limit fraying and impart a finished aspect to the garment. The garment 451 may be provided with one or more zippers, hook and loop fasteners or other releasable fasteners disclosed herein, such as one extending the full or partial length of one or both legs, to facilitate getting into and out of the garment. One or more nonstretch panels may be removably secured to the garment using a zipper or equivalent structure, hook and loop sections or otherwise. This enables the garment to be pulled on in a relatively stretchable mode. Following proper positioning of the garment on the wearer, force transfer features such as one or more low stretch features such as in the form of straps or panels can be secured to the garment to reduce the stretch along the axes which will experience the most tensile force from the resistance units during motion of the wearer.

In general, the low stretch axis will be aligned in the anterior-posterior direction, or at least have a vector resolution component in the anterior posterior direction. Generally the low stretch axis will be within about 45 degrees up or 45 degrees down of horizontal, with the garment in the normal standing (vertical) orientation.

Stretch panels may be formed in the configuration of straps, having a length that exceeds the width, and constructed similar to the watershort waist band of U.S. Pat. No. 7,849,518 or U.S. Pat. No. 8,555,415, previously incorporated herein. The longitudinal axis of the strap may extend circumferentially around the waist or leg above and or below each resistance unit to cooperate with the lever or other force transfer structure to shield the stretch fabric from tensile force. Alternatively, if less constriction on fit is desired, the axis of the strap may be angled up or down with respect to horizontal to extend in a spiral path which extends at least about 20%, often at least about 50% and in some embodiments at least about 75% or 100% or more of the circumference of the wearer's leg or waist. See FIG. 13 which can illustrate a nonstretch strap configuration which may be embedded within or over a multilayer stretch fabric panel garment.

Although disclosed primarily in the context of lower body garments, any of the resistance elements and attachment fabrics and structures disclosed herein can be adopted for use for any other motion segment on the body, including the shoulder, elbow, wrist, neck, abdomen and various other motion segments of the upper body. Any of the various resistance elements and attachment structures disclosed herein can be interchanged with any other, depending upon the desired performance. In addition, the present invention has been primarily disclosed as coupled to a type of garment resembling a complete article of clothing such as that illustrated in FIG. 34 or 44. However any of the resistance systems disclosed herein may be carried by any of a variety of braces, wearable clothing subassemblies or other wearable support construct that is sufficient to mechanically couple one or more resistance elements to the body and achieve the force transfer described herein, that may be worn over or under conventional clothing.

What is claimed is:

1. A toning garment, comprising:

a waist;

a left leg, extending across a left hip;

a right leg, extending across a right hip;

a left fluid filled damper at the left hip, comprising a housing and a rotatable connector;

the housing secured with respect to the waist by adhesive; and a right fluid filled damper at the right hip;

wherein each of the left and right dampers are secured with respect to the corresponding leg by a femoral lever extending inferiorly from the damper and each of the left and right dampers is secured with respect to the hip by a force dissipation layer.

2. A toning garment as in claim 1, wherein the rotatable connector is linked to the leg by the femoral lever so that flexion or extension at the hip causes the connector to rotate.

3. A toning garment as in claim 2, wherein the lever is sufficiently flexible in the medial lateral direction to conform to the leg of a wearer when the garment is worn.

4. A toning garment as in claim 3, further comprising at least one force dissipation panel attached to the lever.

5. A toning garment as in claim 1, wherein the left and right dampers are removably secured to the garment.

6. A toning garment as in claim 1, comprising at least one panel of compression fabric.

7. A lower body toning garment, comprising:

a waist portion, a right leg and a left leg;

a left rotation point on a lateral side of the left leg and a right rotation point on a lateral side of the right leg, the left and right rotation points configured to be functionally aligned with a transverse axis of rotation extending through the center of rotation of a wearer's right and left hip in an as worn orientation;

a left resistance unit mounted at the left rotation point;

a right resistance unit mounted at the right rotation point;

each of the left and right resistance units comprising a housing and a lever arm rotatable through a range of motion;

the housing for the left resistance unit is attached to the garment at the left rotation point and a left lever arm is attached to the left leg; and the housing for the right resistance unit is attached to the garment at the right rotation point and a right lever arm is attached to the right leg, wherein each of the left and right resistance units comprises a fluid filled damper, and the fluid comprises an electrorheological fluid.

8. A lower body toning garment as in claim 7, additionally comprising a force dissipation layer attached to each of the right and left legs.

9. A lower body toning garment as in claim 7, additionally comprising a force dissipation layer attached to each of the right and left lever arms.

10. A lower body toning garment as in claim 7, wherein each of the left and right resistance units provide at least about 10 inch pounds of torque.

11. A lower body toning garment as in claim 7, wherein each of the left and right resistance units provide from about 5 inch pounds to about 50 inch pounds of torque.

12. A lower body toning garment as in claim 7, wherein each of the left and right resistance units provide at least about 15 inch pounds of torque.

13. A lower body toning garment as in claim 7, wherein each of the left and right resistance units provide at least about 20 inch pounds of torque.

14. A lower body toning garment as in claim 7, wherein each of the left and right resistance units is removably mounted to the garment.

15. A lower body toning garment as in claim 11, wherein each of the left and right resistance units maintains resistance within a range, the range extending from a minimum to a maximum and the maximum is no more than about 200% of the minimum.

16. A lower body toning garment as in claim 15, wherein the maximum is no more than about 50% greater than the minimum.

17. A lower body toning garment as in claim 15, wherein the maximum is no more than about 10% greater than the minimum.

18. A lower body toning garment as in claim 8, wherein the force dissipation layer comprises one or more filaments having a low stretch axis extending in the as worn anterior posterior direction within about 45 degrees up and 45 degrees down from horizontal with the garment in a vertical orientation.

19. A lower body toning garment as in claim 7, comprising a fabric which exhibits at least 30% stretch prior to tensile failure.

20. A lower body toning garment as in claim 19, comprising a fabric which exhibits at least 50% stretch prior to tensile failure.

21. A lower body toning garment as in claim 19, comprising a fabric which exhibits at least 80% stretch prior to tensile failure.

22. A toning garment, comprising:

a waist;

a left leg, extending across a left hip;

a right leg, extending across a right hip;

a left fluid filled damper at the left hip, comprising a housing and a rotatable connector, the housing secured with respect to the waist; and a right fluid filled damper at the right hip;

wherein each of the left and right dampers are secured with respect to the corresponding leg by a femoral lever extending inferiorly from the damper and each of the left and right dampers is secured with respect to the hip by a force dissipation layer secured to the garment by stitching.

23. A toning garment as in claim 22, wherein the rotatable connector is linked to the leg by the femoral lever so that flexion or extension at the hip causes the connector to rotate.

24. A toning garment as in claim 23, wherein the femoral lever is sufficiently flexible in the medial lateral direction to conform to the leg of a wearer when the garment is worn.

25. A toning garment as in claim 24, further comprising at least one force dissipation panel attached to the femoral lever.

26. A toning garment as in claim 22, wherein the left and right dampers are removably secured to the garment.

27. A toning garment as in claim 22, comprising at least one panel of compression fabric.

28. A lower body toning garment, comprising:

a waist portion, a right leg and a left leg;

a left rotation point on a lateral side of the left leg and a right rotation point on a lateral side of the right leg, the left and right rotation points configured to be functionally aligned with a transverse axis of rotation extending through a center of rotation of a wearer's right and left hip in an as worn orientation;

a left resistance unit mounted at the left rotation point;

a right resistance unit mounted at the right rotation point;

each of the left and right resistance units comprising a housing and a lever arm rotatable through a range of motion;

the housing for the left resistance unit is attached to the garment at the left rotation point and a left lever arm is attached to the left leg; and the housing for the right resistance unit is attached to the garment at the right rotation point and a right lever arm is attached to the right leg, wherein each of the left and right resistance units comprises a fluid filled damper, and the fluid comprises a magnetorheological fluid.

29. A lower body toning garment as in claim 28, additionally comprising a force dissipation layer attached to each of the right and left legs.

30. A lower body toning garment as in claim 28, additionally comprising a force dissipation layer attached to each of the right and left lever arms.

31. A lower body toning garment as in claim 28, wherein each of the left and right resistance units provide at least about 10 inch pounds of torque.

32. A lower body toning garment as in claim 28, wherein each of the left and right resistance units provide from about 5 inch pounds to about 50 inch pounds of torque.

33. A lower body toning garment as in claim 28, wherein each of the left and right resistance units provide at least about 15 inch pounds of torque.

34. A lower body toning garment as in claim 28, wherein each of the left and right resistance units provide at least about 20 inch pounds of torque.

35. A lower body toning garment as in claim 32, wherein each of the left and right resistance units maintains resistance within a range, the range extending from a minimum to a maximum and the maximum is no more than about 200% of the minimum.

36. A lower body toning garment as in claim 35, wherein the maximum is no more than about 50% greater than the minimum.

37. A lower body toning garment as in claim 35, wherein the maximum is no more than about 10% greater than the minimum.

38. A lower body toning garment as in claim 29, wherein the force dissipation layer comprises one or more filaments having a low stretch axis extending in the as worn anterior posterior direction within about 45 degrees up and 45 degrees down from horizontal with the garment in a vertical orientation.

39. A lower body toning garment as in claim 28, comprising a fabric which exhibits at least 30% stretch prior to tensile failure.

40. A lower body toning garment as in claim 39, comprising a fabric which exhibits at least 50% stretch prior to tensile failure.

41. A lower body toning garment as in claim 39, comprising a fabric which exhibits at least 80% stretch prior to tensile failure.

* * * * *